US009936759B2

(12) United States Patent
Nurse et al.

(10) Patent No.: US 9,936,759 B2
(45) Date of Patent: Apr. 10, 2018

(54) FOOTWEAR AND FOOT SUPPORT MEMBER CONFIGURED TO ALLOW RELATIVE HEEL/FOREFOOT MOTION

(71) Applicant: NIKE, Inc., Beaverton, OR (US)

(72) Inventors: Matthew A. Nurse, Lake Oswego, OR (US); John Hurd, Lake Oswego, OR (US); Jennifer L. Bishop, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 89 days.

(21) Appl. No.: 14/751,510

(22) Filed: Jun. 26, 2015

(65) Prior Publication Data

US 2015/0289584 A1 Oct. 15, 2015

Related U.S. Application Data

(63) Continuation-in-part of application No. 13/804,742, filed on Mar. 14, 2013.
(Continued)

(51) Int. Cl.
*A43B 13/42* (2006.01)
*A43C 11/00* (2006.01)
(Continued)

(52) U.S. Cl.
CPC ..... *A43B 3/0031* (2013.01); *A43B 3/0073* (2013.01); *A43B 7/141* (2013.01);
(Continued)

(58) Field of Classification Search
CPC ..... A43B 7/24; A43B 7/141; A43B 7/144; A43B 7/1465; A43B 7/1485; A43B 7/20;
(Continued)

(56) References Cited

U.S. PATENT DOCUMENTS 643,998 A 2/1900 Batchelor
744,798 A 11/1903 Roberts
(Continued)

FOREIGN PATENT DOCUMENTS

CN 101884449 A 11/2010
CN 201919820 U 8/2011
(Continued)

OTHER PUBLICATIONS

Communication with Extended European Search Report in EP16001983.2 dated Jan. 3, 2017.
(Continued)

*Primary Examiner* — Khoa Huynh
*Assistant Examiner* — Katharine Gracz
(74) *Attorney, Agent, or Firm* — Banner & Witcoff, Ltd.

(57) ABSTRACT

A shoe can include support members for a plantar surface of a foot that include: (a) a heel support plate; (b) a forefoot support plate; (c) a heel securing strap component for securely engaging a heel supporting component with a wearer's heel; and (d) a unidirectional hinge, wherein the hinge allows the heel support plate to rotate internally with respect to the forefoot support plate and limit the heel support plate from rotating externally with respect to the forefoot support plate. The support member allows the shoe to twist and move with the foot, allowing the ankle to remain neutral, rather than the shoe fighting the foot's natural motion. The unidirectional nature of the hinge plate also prevents the shoe from rotating externally beyond a predetermined limit point.

22 Claims, 27 Drawing Sheets

Related U.S. Application Data

(60) Provisional application No. 61/614,268, filed on Mar. 22, 2012.

(51) Int. Cl.

| | |
|---|---|
| ***A43B 3/00*** | (2006.01) |
| ***A43B 7/14*** | (2006.01) |
| ***A43B 7/20*** | (2006.01) |
| ***A43B 13/12*** | (2006.01) |
| ***A43B 13/14*** | (2006.01) |
| ***A43B 13/18*** | (2006.01) |
| ***A43B 23/02*** | (2006.01) |
| ***A43B 23/22*** | (2006.01) |
| ***A43C 11/14*** | (2006.01) |
| ***A43B 7/24*** | (2006.01) |

(52) U.S. Cl.

CPC ..... *A43B 7/144* (2013.01); *A43B 7/148* (2013.01); *A43B 7/1465* (2013.01); *A43B 7/20* (2013.01); *A43B 7/24* (2013.01); *A43B 13/125* (2013.01); *A43B 13/127* (2013.01); *A43B 13/145* (2013.01); *A43B 13/188* (2013.01); *A43B 23/0265* (2013.01); *A43B 23/22* (2013.01); *A43C 11/14* (2013.01)

(58) Field of Classification Search

CPC ... A43B 3/0073; A43B 13/127; A43B 13/145; A43B 13/188; A43B 13/125; A43B 23/22; A43C 11/14; A43C 11/142; A43C 11/146; A43C 1/003

USPC ..... 36/50.1, 69, 76 R

See application file for complete search history.

(56) References Cited

U.S. PATENT DOCUMENTS

| | | | | |
|---|---|---|---|---|
| 1,155,506 | A | | 10/1915 | Osaki |
| 1,328,333 | A | | 1/1920 | Mann |
| 1,920,112 | A | | 7/1933 | Shaft |
| 1,982,357 | A | | 11/1934 | Sebastiani |
| 2,424,609 | A | | 7/1947 | Friedmann, Jr. |
| 2,447,603 | A | | 8/1948 | Snyder |
| 2,508,318 | A | | 5/1950 | Wallach |
| 2,763,071 | A | | 9/1956 | Kingsley |
| 2,767,487 | A | | 10/1956 | Friedmann, Jr. |
| 2,897,611 | A | | 8/1959 | Schaller |
| 3,067,752 | A | | 12/1962 | Schaller et al. |
| 3,613,273 | A | | 10/1971 | Marquis |
| 3,729,840 | A | | 5/1973 | Famolare, Jr. |
| D252,836 | S | | 9/1979 | Picker |
| 4,282,657 | A | | 8/1981 | Antonious |
| 4,364,189 | A | | 12/1982 | Bates |
| 4,492,046 | A | | 1/1985 | Kosova |
| 4,510,701 | A | * | 4/1985 | Schour ..... A43B 5/06 36/132 |
| 4,523,394 | A | * | 6/1985 | Lindh ..... A43B 7/20 36/114 |
| 4,534,124 | A | | 8/1985 | Schnell |
| 4,547,981 | A | | 10/1985 | Thais et al. |
| 4,566,206 | A | | 1/1986 | Weber |
| 4,592,153 | A | | 6/1986 | Jacinto |
| 4,608,970 | A | | 9/1986 | Marck et al. |
| 4,766,681 | A | | 8/1988 | O'Rourke et al. |
| 4,776,111 | A | | 10/1988 | Crowley |
| 4,783,910 | A | | 11/1988 | Boys, II et al. |
| 4,811,498 | A | | 3/1989 | Barret |
| 4,856,209 | A | | 8/1989 | Kenyon |
| 4,878,504 | A | | 11/1989 | Nelson |
| 4,922,631 | A | | 5/1990 | Anderie |
| 4,972,613 | A | | 11/1990 | Loveder |
| 4,989,350 | A | | 2/1991 | Bunch et al. |
| 5,052,130 | A | | 10/1991 | Barry et al. |
| 5,099,588 | A | | 3/1992 | Scholl |
| 5,138,776 | A | | 8/1992 | Levin |
| 5,175,947 | A | | 1/1993 | Parracho |
| 5,187,883 | A | | 2/1993 | Penney |
| 5,195,258 | A | | 3/1993 | Loader |
| 5,269,078 | A | | 12/1993 | Cochrane |
| D346,686 | S | | 5/1994 | Hatfield |
| D346,894 | S | | 5/1994 | Hatfield |
| 5,319,869 | A | * | 6/1994 | McDonald ..... A43B 5/00 36/114 |
| 5,325,611 | A | | 7/1994 | Dyer et al. |
| 5,363,570 | A | | 11/1994 | Allen et al. |
| 5,435,079 | A | | 7/1995 | Gallegos |
| 5,672,156 | A | | 9/1997 | Jimenez Ramos |
| D386,895 | S | | 12/1997 | Hatfield |
| 5,701,686 | A | | 12/1997 | Herr et al. |
| 5,718,063 | A | | 2/1998 | Yamashita et al. |
| 5,771,608 | A | | 6/1998 | Peterson |
| 5,778,563 | A | | 7/1998 | Ahlbaumer |
| 5,819,439 | A | | 10/1998 | Sanchez |
| 5,822,887 | A | | 10/1998 | Turner |
| 5,826,350 | A | | 10/1998 | Wallerstein |
| 5,832,634 | A | | 11/1998 | Wong |
| 5,836,094 | A | | 11/1998 | Figel |
| 5,875,567 | A | | 3/1999 | Bayley |
| 5,946,827 | A | | 9/1999 | Okajima |
| 6,115,941 | A | | 9/2000 | Ellis, III |
| 6,237,254 | B1 | | 5/2001 | Rork et al. |
| 6,295,741 | B1 | | 10/2001 | Kita |
| 6,295,743 | B1 | | 10/2001 | Brooks |
| 6,341,432 | B1 | | 1/2002 | Muller |
| 6,374,515 | B1 | | 4/2002 | Davis |
| 6,449,878 | B1 | | 9/2002 | Lyden |
| 6,467,058 | B1 | | 10/2002 | Chakradhar et al. |
| 6,467,193 | B1 | | 10/2002 | Okajima |
| 6,557,271 | B1 | | 5/2003 | Weaver, III |
| 6,606,804 | B2 | | 8/2003 | Kaneko et al. |
| 6,629,376 | B1 | | 10/2003 | Ellis |
| 6,675,498 | B1 | | 1/2004 | Ellis, III |
| 6,701,644 | B2 | | 3/2004 | Oorei et al. |
| 6,711,834 | B1 | | 3/2004 | Kita |
| 6,715,218 | B2 | | 4/2004 | Johnson |
| 6,775,929 | B2 | | 8/2004 | Katz et al. |
| 6,779,282 | B2 | | 8/2004 | Grohninger |
| 6,782,643 | B2 | | 8/2004 | Brown |
| 6,860,034 | B2 | | 3/2005 | Schmid |
| 6,880,266 | B2 | | 4/2005 | Schoenborn et al. |
| D507,094 | S | | 7/2005 | Lyden |
| 6,928,756 | B1 | | 8/2005 | Haynes |
| 6,964,119 | B2 | | 11/2005 | Weaver, III |
| 6,968,637 | B1 | | 11/2005 | Johnson |
| 7,013,586 | B1 | | 3/2006 | Hatfield et al. |
| 7,073,276 | B2 | | 7/2006 | Swigart |
| 7,100,308 | B2 | | 9/2006 | Aveni |
| 7,143,529 | B2 | | 12/2006 | Robinson, Jr. et al. |
| 7,171,766 | B2 | | 2/2007 | Bouche et al. |
| 7,243,444 | B2 | | 7/2007 | Selner |
| 7,266,908 | B2 | | 9/2007 | Issler |
| 7,334,354 | B2 | | 2/2008 | Foxen et al. |
| 7,337,558 | B2 | | 3/2008 | Terlizzi et al. |
| 7,370,442 | B2 | | 5/2008 | Jung et al. |
| 7,650,707 | B2 | | 1/2010 | Campbell et al. |
| 7,690,133 | B2 | | 4/2010 | Olivieri |
| 7,818,897 | B2 | | 10/2010 | Geer |
| 8,099,880 | B2 | | 1/2012 | Brewer et al. |
| 8,245,419 | B2 | | 8/2012 | Echols |
| 8,250,783 | B2 | | 8/2012 | Luthi et al. |
| 8,365,440 | B2 | | 2/2013 | Rivas et al. |
| 8,776,397 | B2 | | 7/2014 | Borel et al. |
| 8,819,961 | B1 | | 9/2014 | Ellis |
| 9,095,190 | B2 | | 8/2015 | Nurse et al. |
| 2001/0020341 | A1 | | 9/2001 | Rork et al. |
| 2001/0022041 | A1 | | 9/2001 | Gebhard |
| 2001/0034958 | A1 | | 11/2001 | Kaneko et al. |
| 2002/0050078 | A1 | | 5/2002 | Dietrich et al. |
| 2002/0062579 | A1 | | 5/2002 | Caeran |
| 2002/0088141 | A1 | | 7/2002 | Clark |
| 2002/0088144 | A1 | | 7/2002 | Katz et al. |
| 2003/0172548 | A1 | | 9/2003 | Fuerst |
| 2003/0192202 | A1 | | 10/2003 | Schoenborn et al. |

(56) References Cited

U.S. PATENT DOCUMENTS

| | | | | |
|---|---|---|---|---|
| 2004/0168350 | A1 | 9/2004 | Mathieu et al. | |
| 2004/0194344 | A1 | 10/2004 | Tadin | |
| 2004/0216330 | A1 | 11/2004 | Swigart | |
| 2004/0221487 | A1 | 11/2004 | Fried | |
| 2005/0034328 | A1* | 2/2005 | Geer | A43B 3/0036 36/30 R |
| 2005/0102859 | A1 | 5/2005 | Yen | |
| 2005/0126042 | A1* | 6/2005 | Baier | A43C 11/00 36/50.1 |
| 2005/0268485 | A1 | 12/2005 | Sakai | |
| 2005/0278980 | A1* | 12/2005 | Berend | A43B 7/142 36/103 |
| 2006/0010715 | A1 | 1/2006 | Tseng et al. | |
| 2006/0107553 | A1 | 5/2006 | Clark et al. | |
| 2006/0130362 | A1 | 6/2006 | Juan | |
| 2007/0107264 | A1 | 5/2007 | Meschter et al. | |
| 2007/0294920 | A1 | 12/2007 | Baychar | |
| 2007/0295451 | A1 | 12/2007 | Willis | |
| 2008/0034613 | A1 | 2/2008 | Wilkenfeld et al. | |
| 2009/0077831 | A1 | 3/2009 | Mazzarolo | |
| 2009/0100717 | A1 | 4/2009 | Cabanis | |
| 2009/0113758 | A1 | 5/2009 | Nishiwaki et al. | |
| 2009/0300947 | A1 | 12/2009 | Babolat | |
| 2009/0307925 | A1 | 12/2009 | Pfister | |
| 2010/0122472 | A1 | 5/2010 | Wilson et al. | |
| 2010/0154258 | A1 | 6/2010 | Scholz et al. | |
| 2010/0170106 | A1 | 7/2010 | Brewer et al. | |
| 2010/0242305 | A1 | 9/2010 | Liu | |
| 2010/0251571 | A1 | 10/2010 | Woodard | |
| 2011/0000101 | A1 | 1/2011 | Nakano | |
| 2011/0113650 | A1* | 5/2011 | Hurd | A43B 7/20 36/107 |
| 2011/0197469 | A1 | 8/2011 | Nishiwaki et al. | |
| 2012/0011744 | A1 | 1/2012 | Bell et al. | |
| 2012/0198720 | A1 | 8/2012 | Farris et al. | |
| 2013/0247416 | A1 | 9/2013 | Nurse et al. | |
| 2013/0247417 | A1 | 9/2013 | Nurse et al. | |
| 2013/0247418 | A1 | 9/2013 | Nurse et al. | |

FOREIGN PATENT DOCUMENTS

| | | | |
|---|---|---|---|
| DE | 3802522 | A1 | 8/1988 |
| DE | 3927617 | A1 | 2/1991 |
| EP | 1040768 | A1 | 10/2000 |
| EP | 1092358 | A1 | 4/2001 |
| EP | 1447019 | A1 | 8/2004 |
| EP | 1714624 | A1 | 10/2006 |
| JP | 3247726 | B2 | 1/2002 |
| WO | 9404049 | A1 | 3/1994 |
| WO | 9834508 | A1 | 8/1998 |
| WO | 03073882 | A1 | 9/2003 |
| WO | 03075698 | A1 | 9/2003 |
| WO | 2005004656 | A2 | 1/2005 |
| WO | 2006108660 | A1 | 10/2006 |
| WO | 2007024523 | A1 | 3/2007 |
| WO | 2008003771 | A1 | 1/2008 |

OTHER PUBLICATIONS

Communication in EP13717361.3 dated Jan. 25, 2017.
Ektio-Technology, http://www.ektio.com/>, first date of publication unknown but, prior to Aug. 17, 2011, 1 page.
Ektio-Technology, "Booty", http://www.ektio.com/>, first date of publistion unknown but, prior to Aug. 17, 2011, 1 page.
Ektio-Technology, "Strap", http://www.ektio.com/>, first date of publication unknown but, prior to Aug. 17, 2011, 1 page.
Ektio-Technology, "Bumper", http://www.ektio.com/>, first date of publication unknown but, prior to Aug. 17, 2011, 1 page.
Pesca, "Basketball Shoes May Reduce Ankle Injuies", <http://www.npr.org/2011/08/15/139652117/basketball-shoes-may-reduce . . . >, Aug. 15, 2011, 3 pages.
Nov. 18, 2016—(WO) International Search Report and Written Opinion—PCT/US2016/039246.

* cited by examiner

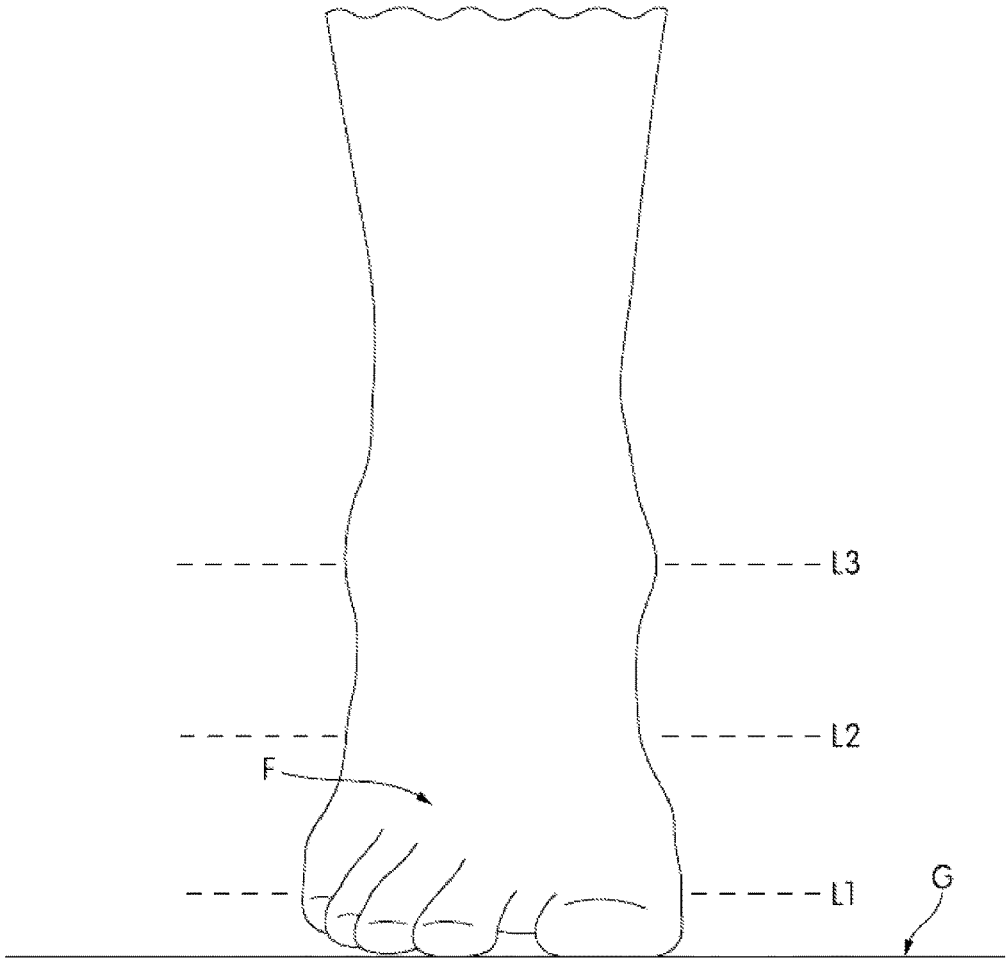
Fig. 1A1

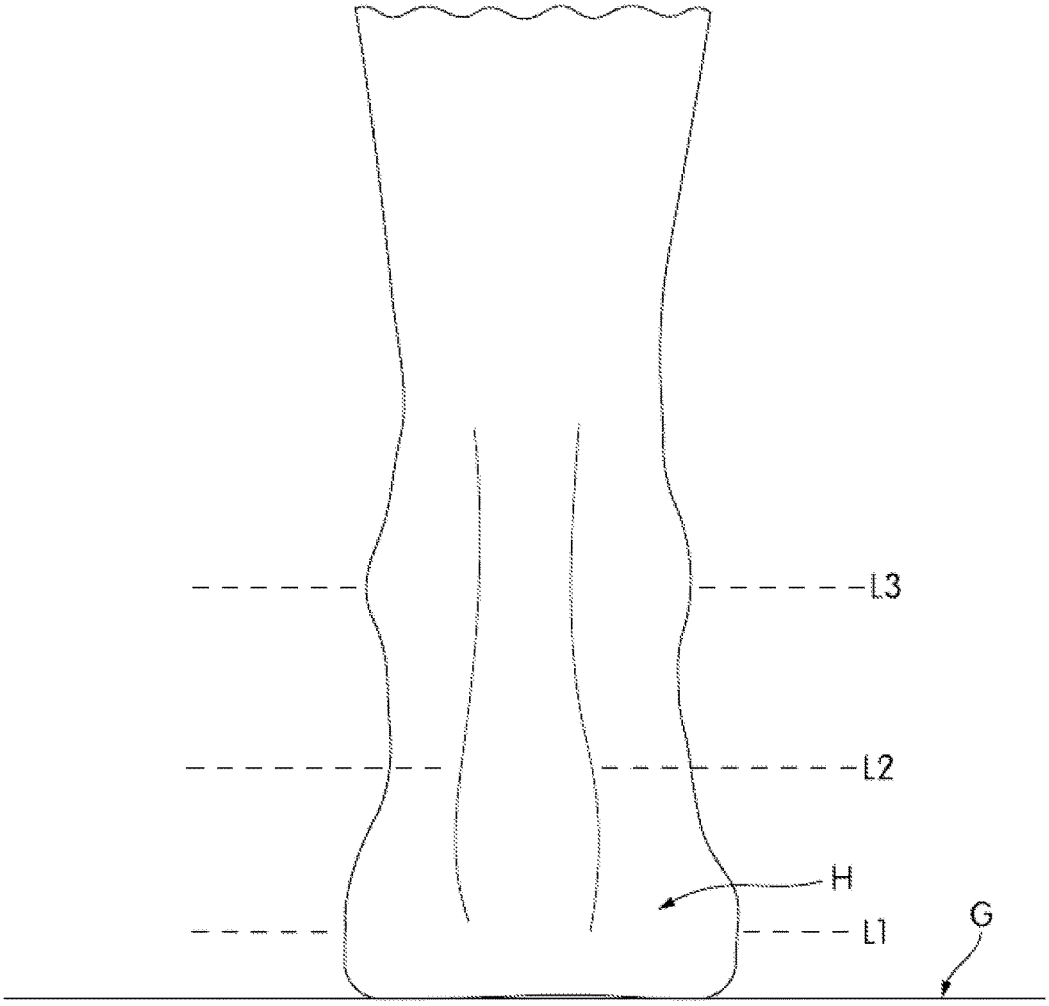
Fig. 1A2

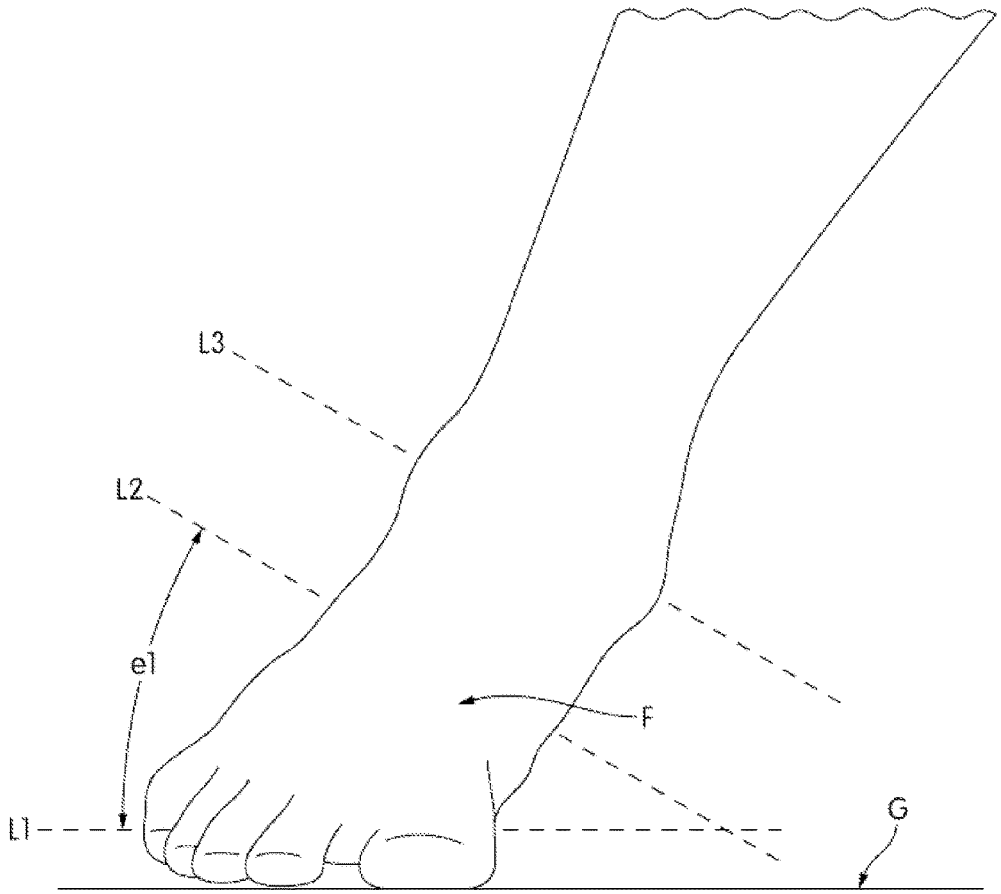
Fig. 1B1

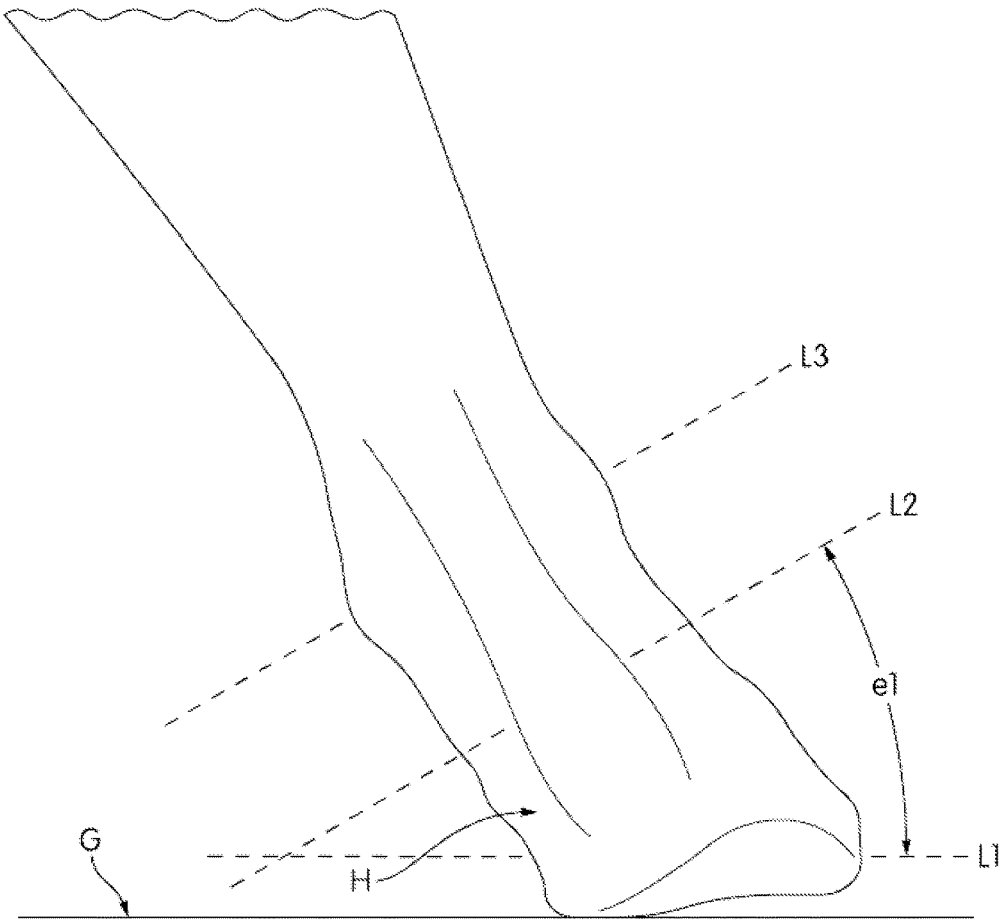
Fig. 1B2

FOOTWEAR AND FOOT SUPPORT MEMBER CONFIGURED TO ALLOW RELATIVE HEEL/FOREFOOT MOTION

RELATED APPLICATION DATA

This application is a continuation-in-part of and/or claims priority to: (a) U.S. patent application Ser. No. 13/804,742, filed Mar. 14, 2013 and (b) U.S. Provisional Patent Application No. 61/614,268, filed Mar. 22, 2012. Each of these priority applications is entirely incorporated herein by references for all purposes.

BACKGROUND

In many athletic and other types of activities, a person may rapidly turn and/or move to the side. One well-known example is a "cut" maneuver performed by a forward moving player in basketball and other sports. During these and other types of events, a person's foot can experience significant forces and motions. Designing footwear to support the foot during such activities remains an ongoing challenge.

BRIEF DESCRIPTION OF THE DRAWINGS

Some embodiments of this invention are illustrated by way of example, and not by way of limitation, in the figures of the accompanying drawings and in which like reference numerals refer to similar elements.

FIGS. 1A1 and 1A2 are front and rear views, respectively, of an unshod foot when a subject is standing straight.

FIGS. 1B1 and 1B2 show outside foot motion during a cutting maneuver by a barefoot individual.

DETAILED DESCRIPTION

Definitions

Figure 1C:
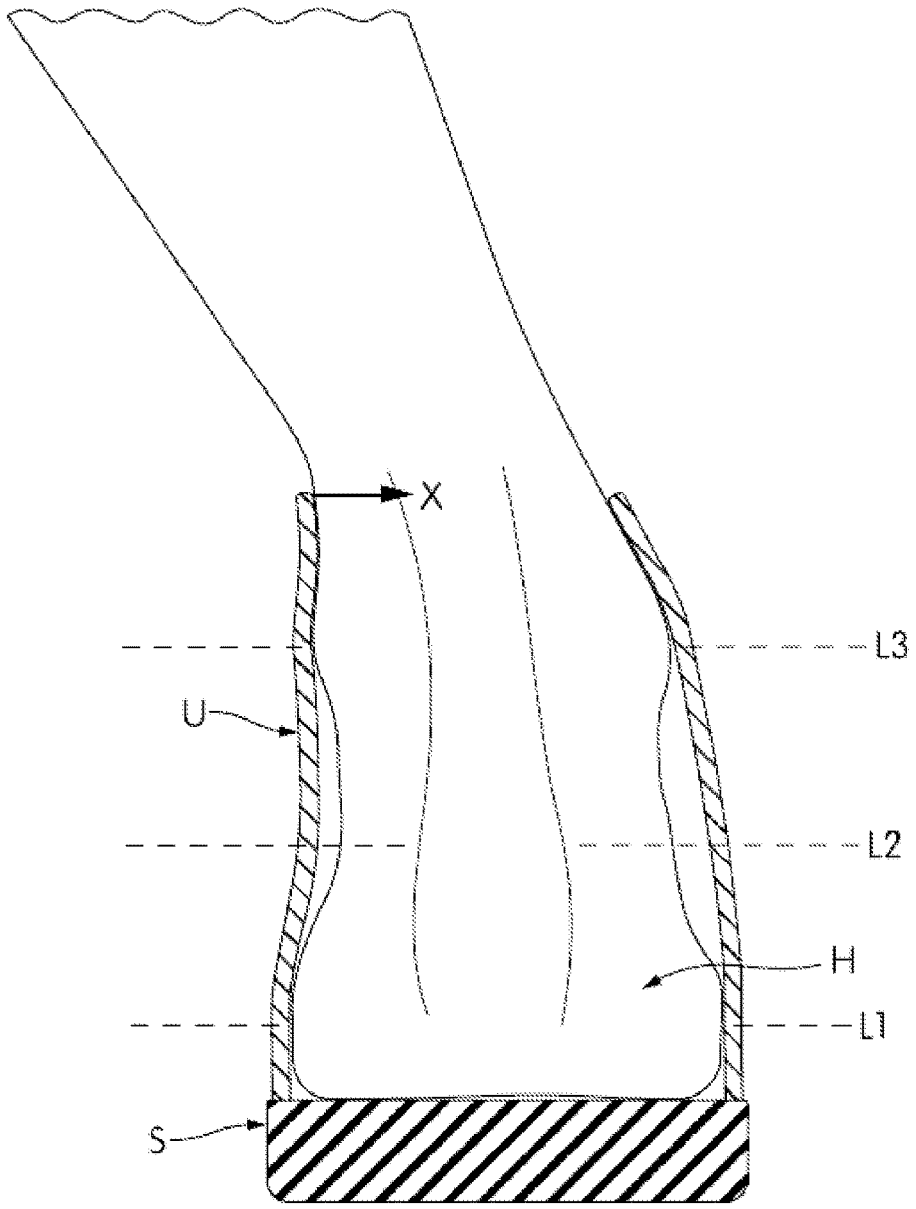
FIG. 1C is a rear view of a shod foot during a cutting maneuver similar to that of FIGS. 1B1 and 1B2.

To assist and clarify subsequent description of various embodiments, various terms are defined herein. Unless context indicates otherwise, the following definitions apply throughout this specification (including the claims). "Shoe" and "article of footwear" are used interchangeably to refer to articles intended for wear on a human foot. A shoe may or may not enclose the entire foot of a wearer. For example, a shoe could include a sandal or other article that exposes large portions of a wearing foot. The "interior" of a shoe refers to space that is occupied by a wearer's foot when the shoe is worn. An "interior side" (or surface) of a shoe element refers to a face of that element that is (or will be) oriented toward the shoe interior in a completed shoe. An "exterior side" (or surface) of an element refers to a face of that element that is (or will be) oriented away from the shoe interior in the completed shoe. In some cases, the interior side of an element may have other elements between that interior side and the interior in the completed shoe. Similarly, an exterior side of an element may have other elements between that exterior side and the space external to the completed shoe.

Shoe elements can be described based on regions and/or anatomical structures of a human foot wearing that shoe, and by assuming that the shoe is properly sized for the wearing foot. As an example, a forefoot region of a foot includes the metatarsal and phalangeal bones. A forefoot element of a shoe is an element having one or more portions located over, under, to the lateral and/or medial side of, and/or in front of a wearer's forefoot (or portion thereof) when the shoe is worn. As another example, a midfoot region of a foot includes the cuboid, navicular, medial cuneiform, intermediate cuneiform and lateral cuneiform bones and the heads of the metatarsal bones. A midfoot element of a shoe is an element having one or more portions located over, under and/or to the lateral and/or medial side of a wearer's midfoot (or portion thereof) when the shoe is worn. As a further example, a hindfoot region of a foot includes the talus and calcaneus bones. A hindfoot element of a shoe is an element having one or more portions located over, under, to the lateral and/or medial side of, and/or behind a wearer's hindfoot (or portion thereof) when the shoe is worn. The forefoot region may overlap with the midfoot region, as may the midfoot and hindfoot regions.

In the following description of several example embodiments, reference is made to the accompanying drawings, which form a part hereof. It is to be understood that other specific arrangements of parts, example systems, and environments may be utilized and structural and functional modifications may be made without departing from the scope of the present invention. Also, while the terms "top," "bottom," "side," "front," "back," "above," "below," "under," "over," and the like may be used in this specification to describe various example features and elements of example embodiments, these terms are used herein as a matter of convenience, e.g., based on the example orientations shown in the figures and/or a typical orientation during use. Unless indicated to the contrary, nothing in this specification should be construed as requiring a specific three dimensional orientation of structures with respect to an external object or the external environment in order to fall within the scope of this invention.

Foot Motion During Sideways Body Movements

In many types of athletic and other activities, a person may rapidly move to his or her side. For example, basketball and other sports often require a forward-moving player to rapidly "cut" to the left or right. In these cutting maneuvers, the player typically pushes hard on the outside foot (the right foot when cutting left, and vice versa). As a result, that outside foot can experience significant sideways forces and motions. A person can impose similar forces and motions on a foot when moving quickly to the left or right from a standing position. Other types of activities (e.g., shuttle running, jumping) can also impose these types of forces and movements to varying degrees. Even simple turning and/or running on a curved route can impose these types of forces and movements.

For reference purposes, FIGS. 1A1 and 1A2 respectively show front (anterior) and rear (posterior) views of an unshod foot when a subject is standing upright. As seen in these figures, the bottom (plantar) surfaces of the heel H and forefoot F of a subject's foot are both resting on the ground G in a generally flat condition. The talar joint is neutral with respect to the forefoot, as there is minimal plantar or dorsial flexion. The subtalar joint is neutral with respect to the heel. There is no eversion of the heel relative to the ankle, as the calcaneus is not angled toward the lateral side of the talus. There is also no inversion of the heel relative to the ankle, as the calcaneus is not angled toward the medial side of the talus.

Horizontal lines L1, L2 and L3 are included in FIGS. 1A1 and 1A2 for purposes of comparison with later drawing figures. Line L1 is drawn through an arbitrary horizontal transverse axis in forefoot F. Because relative positions of forefoot bones can change during foot movements, line L1 is also assumed to be fixed relative to a single forefoot bone (e.g., the distal end of the first metatarsal). Horizontal line L2 is drawn through an arbitrary transverse axis in heel H and is assumed to be fixed relative to the calcaneus. Horizontal line L3 is drawn through an arbitrary transverse axis in the ankle A and is assumed to be fixed relative to the talus.

FIGS. 1B1 and 1B2 show outside foot motion during a 90-degree cutting maneuver by a barefoot individual. FIGS. 1B1 and 1B2 are not intended as exact reproductions of any specific instance of testing. Instead, FIGS. 1B1 and 1B2 were prepared to generally illustrate the type of motion that an unshod foot can experience during a cut. FIG. 1B1 is a front view of an unshod outside foot in the later stage of a cut. In particular, FIG. 1B1 depicts a time point in the cut after the outside foot has landed and the subject has completed roughly 50% of the maneuver. FIG. 1B2 is a rear view of that same foot at the same time point. In FIGS. 1B1 and 1B2, lines L1-L3 have the same fixed positions relative to the single forefoot bone, to the calcaneus, and to the talus, respectively, as those lines have in connection with FIGS. 1A1 and 1A2.

As seen in FIG. 1B1, and at least along transverse directions, forefoot F is generally flat relative to the plane of the ground surface G. Line L1 remains generally parallel to the ground surface G. Heel H is now everted relative to forefoot F, however. In particular, and as shown in both FIGS. 1B1 and 1B2, line L2 is now at an eversion angle e1 relative to line L1. During tests involving barefoot cutting maneuvers, heel/forefoot eversion angles (e.g., angle e1) of approximately 20° to 30° were observed. As also seen in FIGS. 1B1 and 1B2, however, the subtalar joint of ankle A remains neutral. A comparison of lines L2 and L3 shows that these lines are generally parallel. Thus, the calcaneus is generally not everted with respect to the talus. As a result, the subject's heel and lower leg remain relatively straight.

The barefoot motions of FIGS. 1B1 and 1B2 reflect natural tendencies of a human foot during extreme sideways maneuvers. Conventional uppers and sole structures can resist normal foot motion. This is illustrated in FIG. 1C, a rear view of a shod foot during a cutting maneuver similar to that of FIGS. 1B1 and 1B2 and at the same time point in the cutting maneuver. As with FIGS. 1B1 and 1B2, FIG. 1C is not intended as an exact reproduction of any specific instance of testing, and was instead prepared to generally illustrate a type of motion observed. Lines L1, L2 and L3 in FIG. 1C have the same fixed positions relative to foot bones as in previous figures.

In the example of FIG. 1C, the subject is wearing a shoe of conventional design. Elements of the shoe are shown in area cross section so that the position of the foot can be seen. The shoe includes a conventional high-top upper U that is secured around the foot by lacing (not shown). Upper U is substantially inelastic and does not appreciably stretch under loads imposed by wearer activity. Upper U is secured to a conventional sole structure S along substantially all of the interface between sole structure S and upper U. A lower edge of upper U is anchored to sole structure S around the entire perimeter of the foot, with the location of that anchoring being generally aligned with (or just to the inside or outside of) that perimeter.

In the scenario of FIG. 1C, tension in the lateral hindfoot portion of upper U is translated to the medial ankle collar region of upper U. This creates a force X that tends to pull the ankle laterally. Consequently, the lower leg is no longer in its naturally straight condition. Instead, and as can be seen by comparing lines L2 and L3, the heel is inverted relative to the ankle. Moreover, the natural heel-forefoot eversion (angle e1 in FIG. 1B2) is reduced or eliminated.

At least some embodiments of the present invention include shoes and/or shoe elements that facilitate natural foot motion and/or reduce forces tending to fight natural foot motion.

In at least some embodiments, a wearer's heel is secured to the hindfoot region of a shoe in a manner that permits heel/forefoot rotation and that allows the lower leg to remain more straight or neutral. In some such embodiments, the heel is secured in this manner using a strap system. The strap system can also be incorporated into an upper that includes elastic portions in the hindfoot region.

In at least some embodiments, support members for a plantar surface of a foot include: (a) a heel support plate that includes a heel lateral wing and a heel medial wing, wherein the heel lateral wing extends from the heel support plate on a lateral side of the support member and the heel medial wing extends from the heel support plate on a medial side of the support member; and (b) a forefoot support plate that includes a forefoot lateral wing and a forefoot medial wing, wherein the forefoot lateral wing extends from the forefoot support plate on a lateral side of the support member and the forefoot medial wing extends from the forefoot support plate on a medial side of the support member. The interaction of the wings of the heel support plate and the forefoot support plate allow the heel support plate to rotate internally with respect to the forefoot support plate and limit an extent to which the heel support plate is capable of rotating externally with respect to the forefoot support plate.

Embodiments of this invention also comprise shoes that include at least some features of the abovementioned foot support members. Additionally, shoes and/or articles of footwear may include a hindfoot strap system that can secure a wearer's heel to a sole structure while reducing unnatural constraints imposed by many conventional footwear designs. For example, the strap system may include an ankle strap, a lateral heel strap, and a medial heel strap. The strap system may be configured such that, when the shoe is worn by the wearer, the ankle strap completely surrounds and is secured to the wearer's ankle, the lateral heel strap extends from a wearer's lateral malleolus area (e.g., at, above, or below the lateral malleolus) to a lateral anchor location under a heel of the wearer's foot, and the medial heel strap extends from a wearer's medial malleolus area (e.g., at, above, or below the medial malleolus) to a medial anchor location under the heel of the wearer's foot. Although some embodiments are described below in connection with certain specific shoes and/or by describing certain shapes, sizes and locations of various shoe elements, any specifics are merely examples. Similarly, various examples may include shoes intended for certain activities. Other embodiments include shoes intended for use in activities that may not be explicitly mentioned herein. Embodiments are not limited to complete shoes. Thus, some embodiments include portions of shoes, processes for fabricating shoes or shoe portions, and processes of using shoes or shoe portions.

Hindfoot Strap System Permitting Natural Foot Motion

At least some embodiments include a shoe in which the upper comprises a hindfoot strap system. That strap system can secure a wearer's heel to a sole structure while reducing unnatural constraints imposed by many conventional footwear designs. For example, some uppers utilizing such a strap system permit greater eversion of a heel relative to a forefoot and allow a lower leg to remain straighter during cutting maneuvers.

Figure 2A:
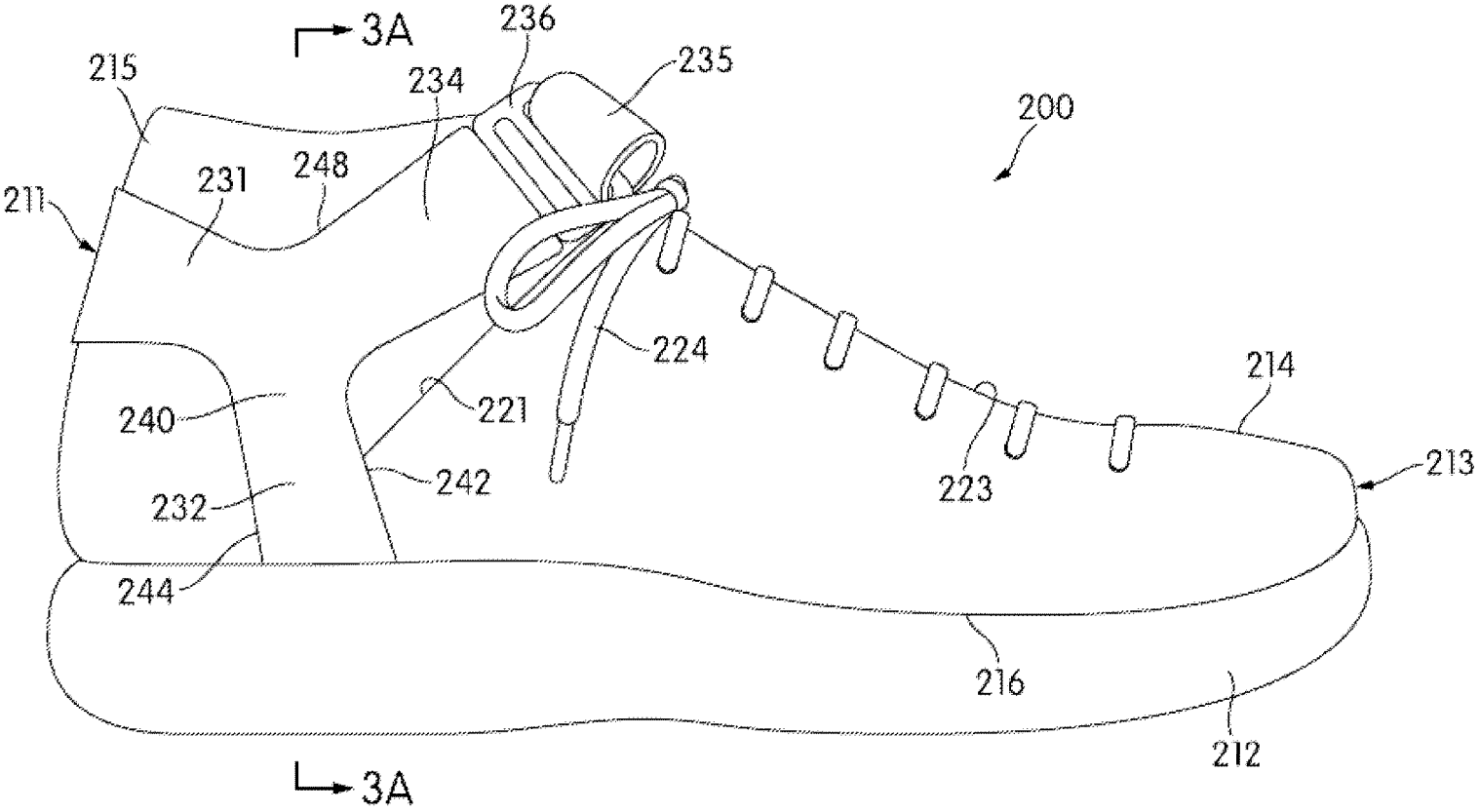
FIGS. 2A, 2B and 2C are lateral, rear and medial views, respectively, of a shoe according to some embodiments.
Figure 2B:
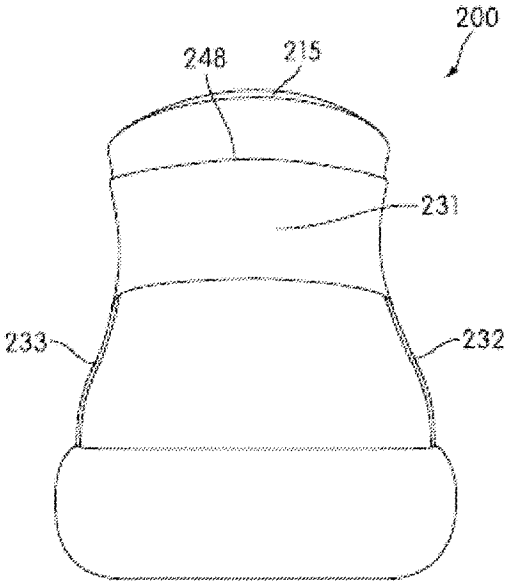
Figure 2C:
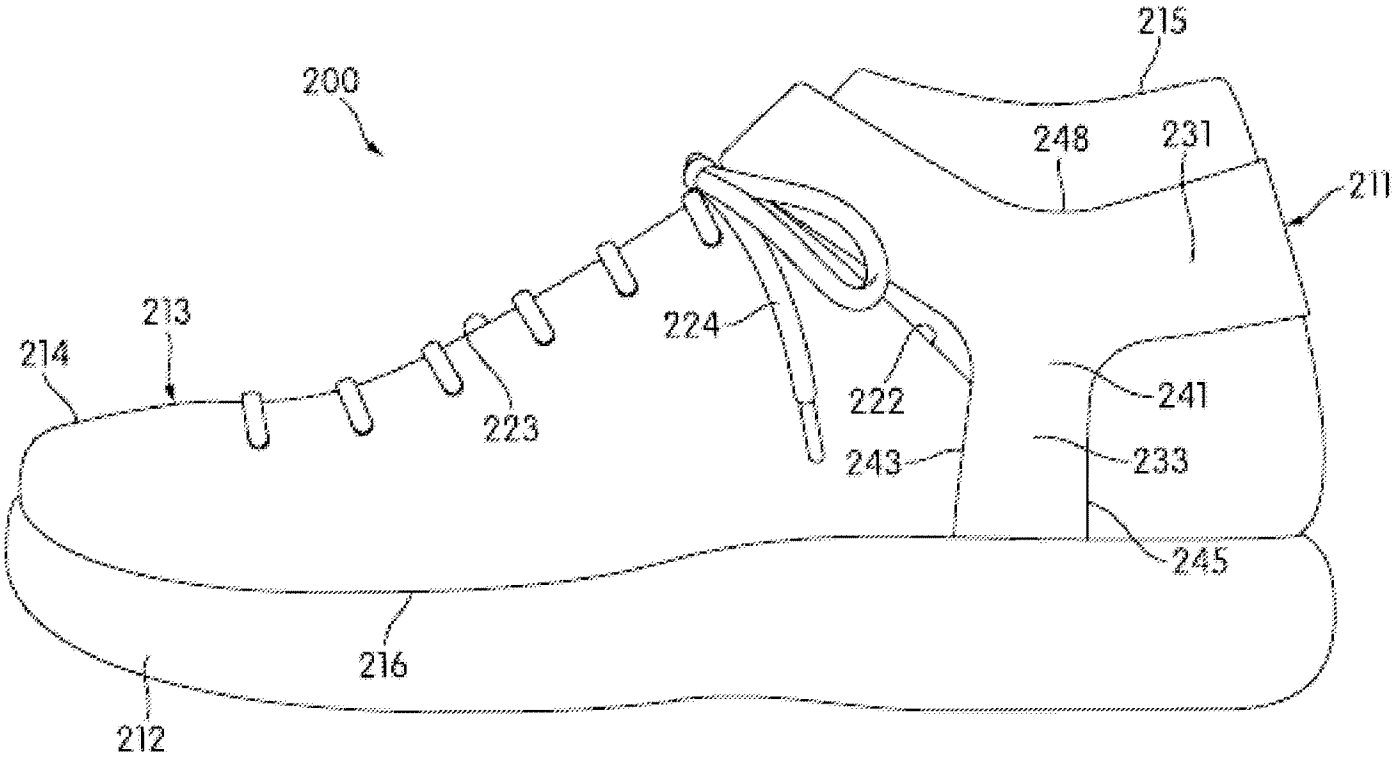

FIGS. 2A through 2C are lateral, rear and medial views of a shoe 200, according to some embodiments, in which an upper includes a hindfoot strap system. Shoe 200 includes a sole structure 212 and an upper 213. Upper 213 includes a forward element 214, a hindfoot strap system 211 and a bootie 215. Sole structure 212 could be any of numerous widely varying types of sole structures. As one example, sole structure 212 could be a single piece molded from synthetic rubber or other material. As another example, sole structure 212 could include multiple components that have been sequentially molded or otherwise bonded together. Such a sole structure could include a midsole formed from a first material (e.g., foamed ethylene vinyl acetate) bonded to an outsole formed from different materials (e.g., synthetic rubber). Sole structure 212 could also include one or more fluid-filled bladders, a stiffening plate or other support element(s), traction elements (e.g., cleats), etc. For convenience, and because of the numerous variations in sole structures that can be included in various embodiments of shoe 200, sole structure 212 is treated as a single unitary component in FIGS. 2A-2C.

Forward element 214 of upper 213 covers a wearer's forefoot and includes portions that extend partially into the wearer's midfoot and hindfoot regions. A lower edge 216 of forward element 214 is anchored to sole structure 212. An internal cavity between element 214 and sole structure 212 contains a wearer's forefoot. Although not visible in FIG. 2A, a lateral side corner of edge 221 is in a location that is approximately aligned with a wearer's cuboid and/or with posterior portions of the wearer's talus and calcaneus. Similarly, a medial side corner of edge 222, not visible in FIG. 2C, is in a location that is approximately aligned with a wearer's navicular and/or with posterior portions of the wearer's talus and calcaneus. Lateral rear edge 221 of element 214 extends forward and upward to a lateral side of a tongue opening 403. Tongue opening 403 is not visible in FIGS. 2A-2C, but it is visible in FIG. 4. Medial rear edge 222 of element 214 extends forward and upward to a medial side of tongue opening 403. A tongue 402 (FIG. 4) bridges the space of tongue opening 403. Tongue opening 403 can be cinched by a lace 224 so as to secure and conform element 214 to the wearer's forefoot. Lace 224 is threaded through eyelets on the lateral and medial sides of tongue opening 403, with the rearmost of those eyelets being approximately located over a wearer's intermediate and lateral cuneiform bones when lace 224 is tied in a normally tight manner. As explained in more detail below, element 214 secures a wearer's forefoot to sole structure 212.

Strap system 211 includes an ankle strap 231, a lateral heel strap 232 and a medial heel strap 233. As also explained in more detail below, strap system 211 secures a wearer's heel to sole structure 212. The front portion of ankle strap 231 can be connected and unconnected to allow a wearer to don and remove shoe 200. Specifically, a lateral end 234 of ankle strap 231 can be attached to a medial end 235 of ankle strap 231 so as to secure ankle strap 231 around the wearer's foot under the lateral (fibular) and medial (tibial) malleoli. In the embodiment shown in FIGS. 2A-2C, lateral end 234 includes a ring 236 attached to its end. Medial end 235 includes panels of hook material and pile material. After passing medial end 235 through ring 236, medial end 235 can be secured to itself by pressing the hook panel onto the pile panel. In other embodiments, ends 234 and 235 can be secured in a different manner. For example, each of ends 234 and 235 could include one or more eyelets through which lace 224 (or a separate lace) can be threaded and then tied. As other examples, buckles, snaps or other types of connection mechanisms could be used to attach ends of an ankle strap 231.

A top portion 240 of lateral heel strap 232 is coupled to ankle strap 231 under the wearer's lateral malleolus in this example. Similarly, a top portion 241 of medial heel strap 233 is coupled to ankle strap 231 under the wearer's medial malleolus in this example. Top portions 240 and 241 can be coupled to ankle strap 231 by direct attachment or in other ways. In some embodiments, for example, a top portion of a heel strap could be pivotally attached to ankle strap 231 with a rivet. As another example, ankle strap 231 and heel straps 232 and 233 could be cut as a single piece from a larger panel of material. Forward edges 242 and 243 of lateral heel strap 232 and medial heel strap 233 are located in the hindfoot and/or midfoot regions of upper 213. Rear edges 244 and 245 of lateral heel strap 232 and medial heel strap 233 are located in the hindfoot region of upper 213.

In at least some embodiments, ankle strap 231 is asymmetric so as to conform to the asymmetric shape of an ankle region. When the lateral and medial ends 234 and 235 of strap 231 are secured, the front of strap 231 generally rests over the wearer's navicular and cuboid and/or over anterior portions of the talus. The lateral side of strap 231 angles downward from the front so that an upper edge 248 of strap 231 is below the lateral malleolus. The lateral side of strap 231 then angles upward behind the lateral malleolus so as to be positioned above the calcaneus tuberosity and approximately aligned with the talus. After the lateral side of ankle strap 231 continues around the rear of the foot and becomes the medial side of ankle strap 231, it angles downward so that upper edge 248 is below the medial malleolus. The medial side of ankle strap 231 then angles upward toward the front. Because the lateral malleolus is below and to the rear of the medial malleolus, ankle strap 231 is thus asymmetric. Indeed, strap system 211 as a whole is asymmetric. Because heel straps 232 and 233 are coupled to ankle strap 231 under the malleoli, lateral heel strap 232 is shorter and more rearward than medial heel strap 233.

Bootie 215 is included in upper 213 to enhance wearer comfort. For example, bootie 215 moderates the force applied by strap system 211 to a wearer's skin, e.g., to prevent chafing. Bootie 215 also provides abrasion protection to wearer skin in the heel region. In other embodiments, bootie 215 may be omitted. Bootie 215 may be configured so as not to restrict heel movement. For example, bootie 215 may rest within strap system 211, but it may be unattached to strap system 211 or to sole structure 212. A forward edge of bootie 215 (not shown) is attached to forward element 214, but the portion of bootie 215 rearward of that attachment may be free to move relative to strap system 211 and sole structure 212. In other embodiments, bootie 215 may be glued to sole structure 212.

In some embodiments, forward element 214 and strap system 211 are substantially inelastic. In other words, neither forward element 214 nor strap system 211 appreciably stretches under loads typically imposed by a wearer in normal use. Because of the way in which these components are attached to sole structure 212, however, natural foot motion is accommodated. Forward element 214 is anchored to sole structure 212 at or around the outer perimeter of a wearer's forefoot. Thus, forward element 214 serves to hold the forefoot flat against sole structure 212. Because the forefoot does not rotate relative to the forefoot portion of the sole structure (or only rotates a small amount), the forefoot is thus non-rotationally secured to the forefoot portion of the sole structure. This is not a concern, however. As indicated above in connection with FIG. 1B1, the forefoot remains relatively flat during sideways maneuvers. Thus, forefoot element 214 does not force the forefoot into an unnatural position and does not fight against natural motion tendencies of the foot.

Figure 3A:
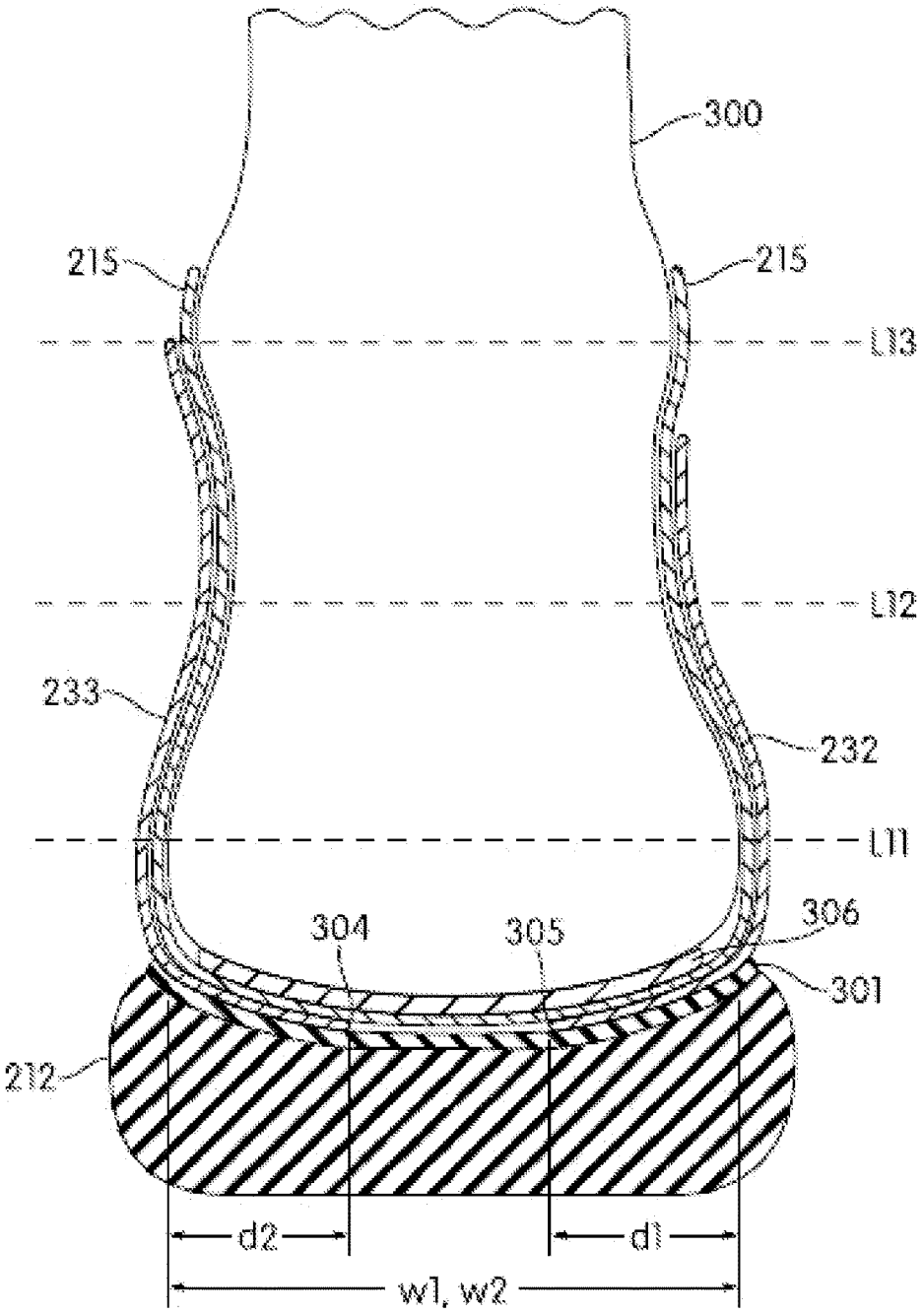
FIGS. 3A and 3B are area cross-sectional views of the shoe shown in FIGS. 2A through 2C.
Figure 3B:
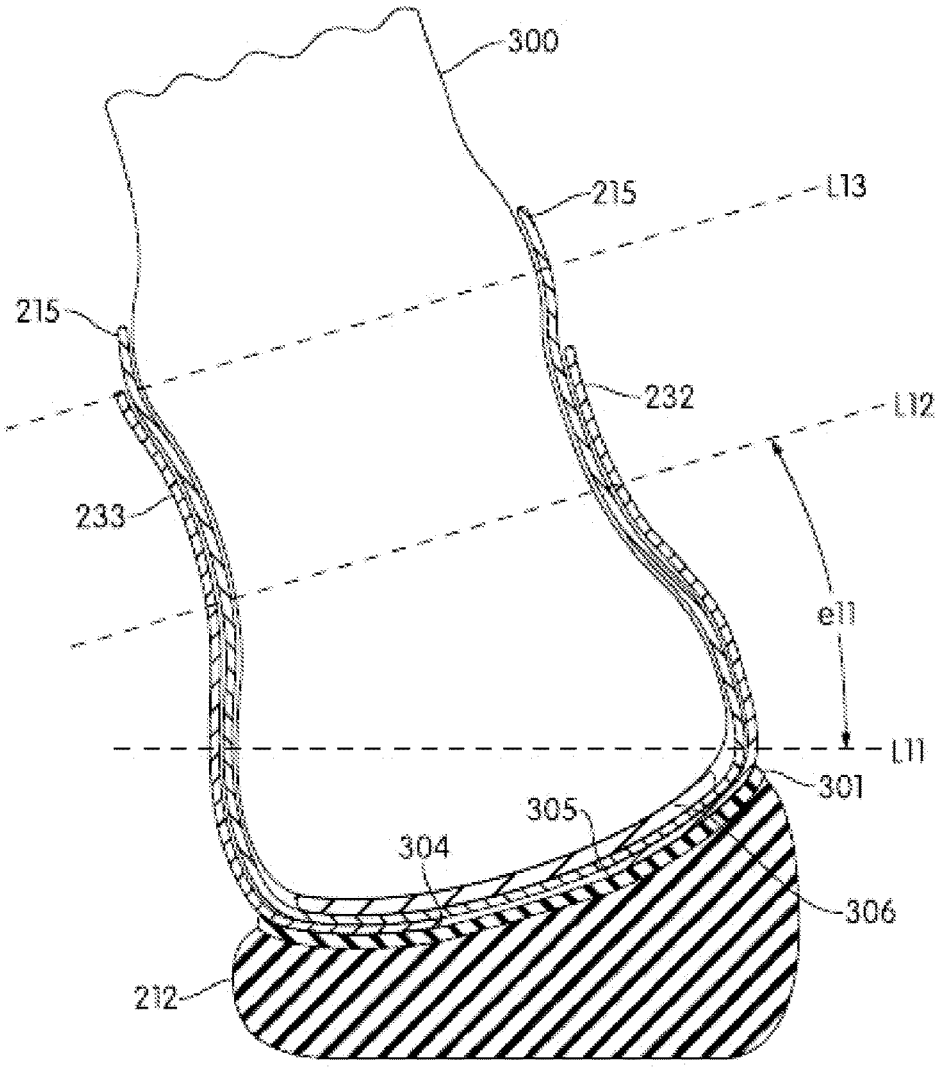

Conversely, strap system 211 accommodates the foot motion described above in connection with FIG. 1B2 and allows increased motion of a heel relative to a forefoot. In particular, strap system 211 secures a wearer's heel to sole structure 212 and allows the wearer's heel to tilt relative to the forward portion of sole structure 212, thereby permitting heel rotation relative to the forefoot. This is illustrated in FIGS. 3A and 3B. FIG. 3A is an area cross-sectional view of shoe 200 partially taken from the location indicated in FIG. 2A. As indicated above, strap system 211 is not symmetric. Accordingly, the sectioning plane on the left side of FIGS. 3A and 3B is forwardly offset (i.e., toward to the toe of shoe 200) from the sectioning plane on the right side of the figure so as to show straps 232 and 233. A wearer's foot 300 is added in FIGS. 3A and 3B, but the internal anatomy of foot 300 in the sectioning plane is not shown. Lines L11, L12 and L13 in FIGS. 3A and 3B are respectively similar to lines L1, L2 and L3 of FIGS. 1A1 through 1C. For convenience, small pieces of forward element 214 that might also appear in the cross sectional views of FIGS. 3A and 3B have also been omitted.

FIG. 3A shows a hindfoot portion of a wearer's foot 300 when the wearer is standing upright on a horizontal surface. For purposes of clarification, some space has been added between adjacent elements in FIG. 3A. In an actual shoe, some or all of that added space could be absent and elements shown to be separated in FIG. 3A might be in direct contact. In addition to strap system 211, sole structure 212 and bootie 215, FIG. 3A shows a base member 301. Base member 301 can be a Strobel or other type of lasting element. The base member 301 can be stitched to forward element 214 and bonded to sole structure 212 in a manner described below. FIG. 3A also shows a sock liner 306 resting within bootie 215. Sock liner 306 may extend the full length of the interior of shoe 200. As indicated above, bootie 215 may not be attached to sole structure 212 in the heel region. Sock liner 306 may similarly be unattached to sole structure 212 in the heel region, although a lower surface of liner 306 could be coated with a tacky material (e.g., a glue that does not fully cure) so as to prevent slipping between liner 306 and bootie 215 or between liner 306 and sole structure 212 in forefoot regions of shoe 200.

As seen in FIG. 3A, a bottom portion of lateral heel strap 232 is anchored to base member 301 (and thus to sole structure 212) at a location 305 under the heel of foot 300. Anchor location 305 is well inside the outer perimeter of the foot 300 heel and lies under the lateral front part of the heel fat pad. In some embodiments, the transverse distance d1 from anchor location 305 to the lateral perimeter of the foot is at least 10% of the average cross-heel width w1 at a point along the longitudinal length of shoe 200 corresponding to location 305. In other embodiments, the transverse distance d1 is at least 15% or at least 20% of that average cross-heel width w1. The underside portion of lateral heel strap 232 extending from location 305 and contacting base member 301 may be glued or otherwise fixed to base member 301.

As also shown in FIG. 3A, a bottom portion of medial heel strap 233 is anchored to base member 301 and to sole structure 212 at a location 304 under the heel of foot 300. Anchor location 304 is also well inside the outer perimeter of the foot 300 heel and lies under the medial front part of the heel fat pad. In some embodiments, the transverse distance d2 from anchor location 304 to the medial perimeter of the foot is at least 10% of the average cross-heel width w2 at a point along the longitudinal length of shoe 200 corresponding to anchor location 304. In other embodiments, the transverse distance d2 is at least 15% or at least 20% of that average cross-heel width w2. Distance w1 may be the same as distance w2, but this need not be the case. Similarly, distances d1 and d2 may, but need not, be equal. The underside portion of medial heel strap 233 extending from location 304 and contacting base member 301 may be glued or otherwise fixed to base member 301.

FIG. 3B is an area cross-sectional view of shoe 200 taken from the same location as FIG. 3A. In FIG. 3B, however, foot 300 is the outside foot while the wearer of shoe 200 is performing a cutting maneuver. As seen in FIG. 3B, shoe 200 allows movement of foot 300 that is more like the barefoot movement seen in FIG. 1B2. The configuration of heel straps 233 and 232 and strap system 211 can accommodate the motion of foot 300 with less laterally outward pulling of the foot 300 ankle than has been observed in conventional shoes. For example, the positioning of anchor locations 304 and 305 allows reduction of the forces on strap system 211 and other portions of upper 213 during various extreme movements that might be contrary to natural motion. As a result, and as is shown by lines L12 and L13 being roughly parallel, the lower leg is straighter and in a condition that more closely conforms to natural foot motion. The natural eversion of the foot 300 heel relative to the forefoot is present, as can be seen by comparing lines L11 and L12. The eversion angle e11 may approach the barefoot version angle e1 (see FIG. 1B2).

FIG. 3B assumes that sole structure 212 is a deformable elastomeric material. The degree of deformation in the hindfoot region of sole structure 212 is exaggerated in FIG. 3B for purposes of illustration. Nonetheless, under conditions such as those described in connection with FIG. 3B, strap system 211 would facilitate compression of the medial side of the hindfoot region of sole structure 212 and expansion of the lateral side of the hindfoot region of sole structure 212. In turn, this would help permit rotation of the wearer's ankle relative to the wearer's forefoot. Other structures for supporting the relative heel and forefoot motion are described in more detail below, e.g., in conjunction with FIGS. 7A-11D.

Straps 231, 232 and 233 can be formed from various materials. In some embodiments, one or more of straps 231, 232 and 233 can include embedded reinforcing fiber strands. Example materials for such strands include liquid crystal polymer (LCP) fibers of aromatic polyester such as are sold under the trade name VECTRAN by Kuraray America, Inc. Other example strand materials include but are not limited to nylon and high-tensile polyester. As previously indicated, strap system 211 could be cut as a single piece from a larger piece of material. Alternatively, straps 231, 232 and/or 233 (or portions thereof) could be formed separately and then joined together (e.g., by sewn seams, etc.).

Figure 4:
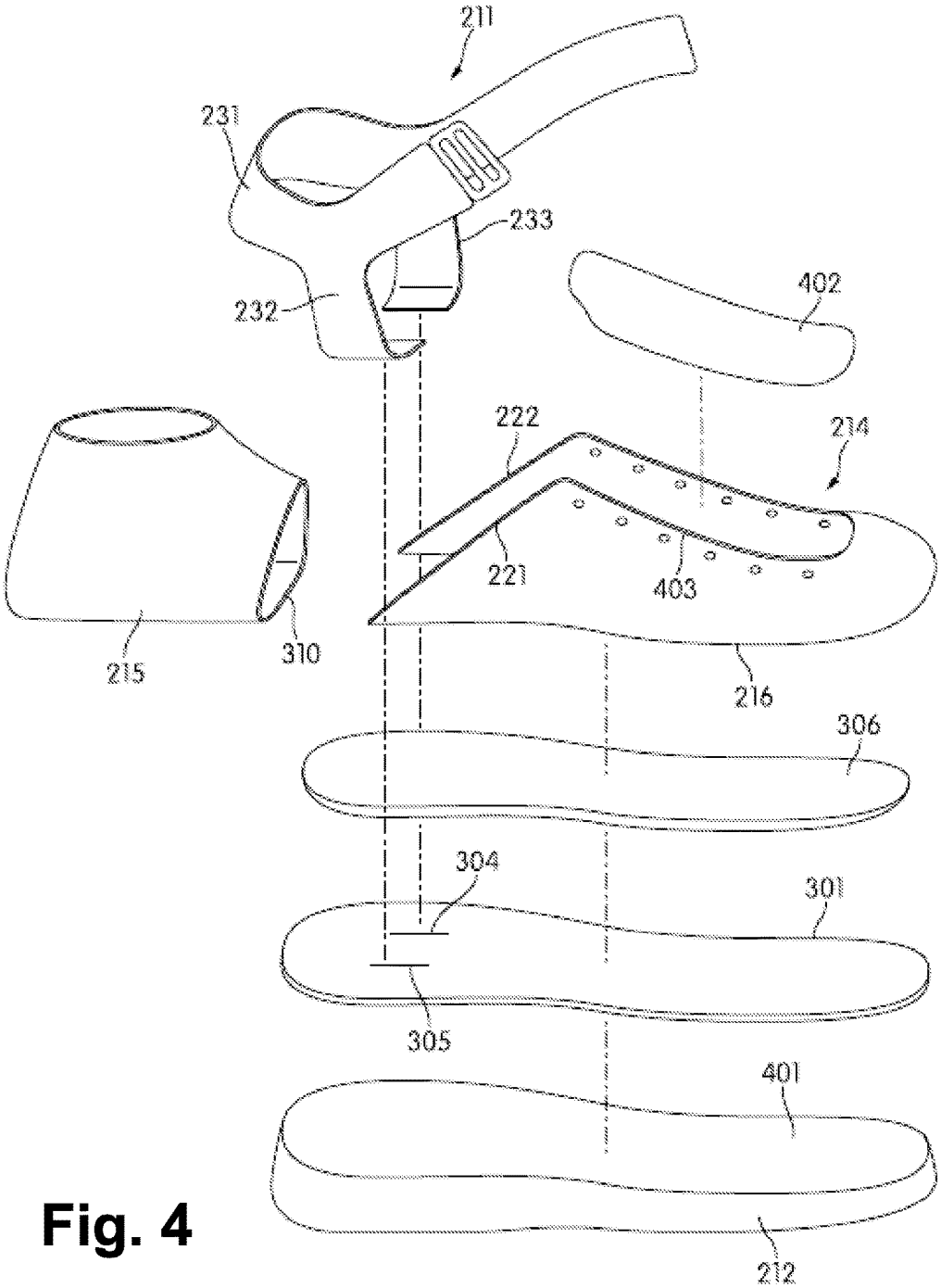
FIG. 4 is an exploded view of a shoe according to some embodiments.

FIG. 4 is an exploded view of shoe 200. Shoe 200 could be assembled by first attaching edge 310 of bootie 215 to interior regions of forward element 214. Next, lower edge 216 of forward element 214 can be stitched or otherwise attached to the outside edge of base member 301 in the corresponding regions of the base member 301 outer perimeter. The end of lateral heel strap 232 and the end of medial heel strap 233 could then be stitched to lateral anchor location 305 and to medial anchor location 304, respectively, on base member 301. The underside portion of lateral heel strap 232 extending from location 305 and contacting base member 301 may be glued or otherwise bonded to base member 301. The underside portion of medial heel strap 233 extending from location 304 and contacting base member 301 may be glued or otherwise bonded to base member 301. The bottom surface of base member 301 can be glued or otherwise attached to top surface 401 of sole assembly 212. Tongue 402 can be stitched in place and sock liner 306 inserted over bootie 215 and base member 301.

Figure 5A:
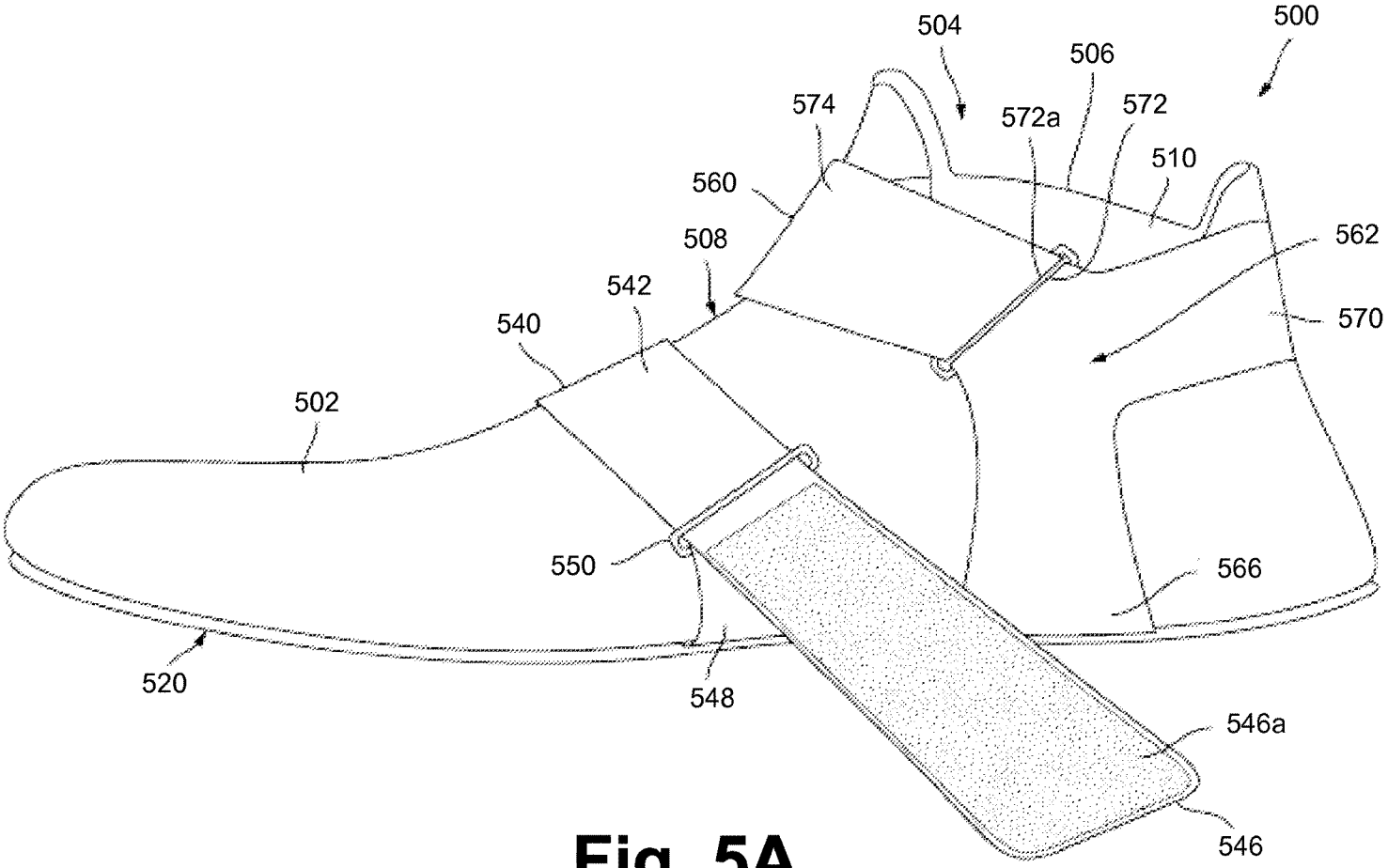
FIGS. 5A through 5D illustrate various views of an upper bootie and strap in accordance with at least some embodiments.
Figure 5B:
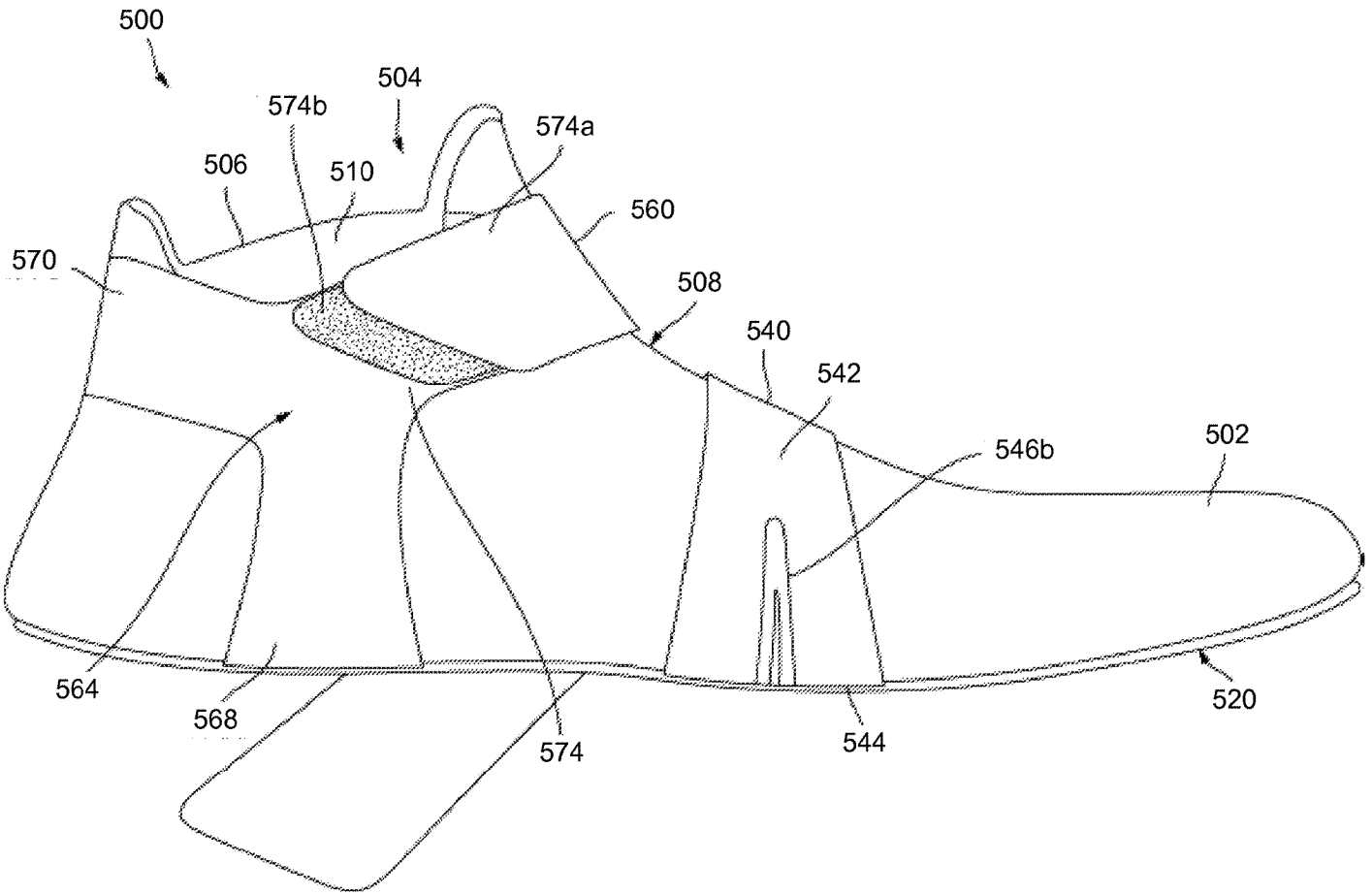
Figure 5C:
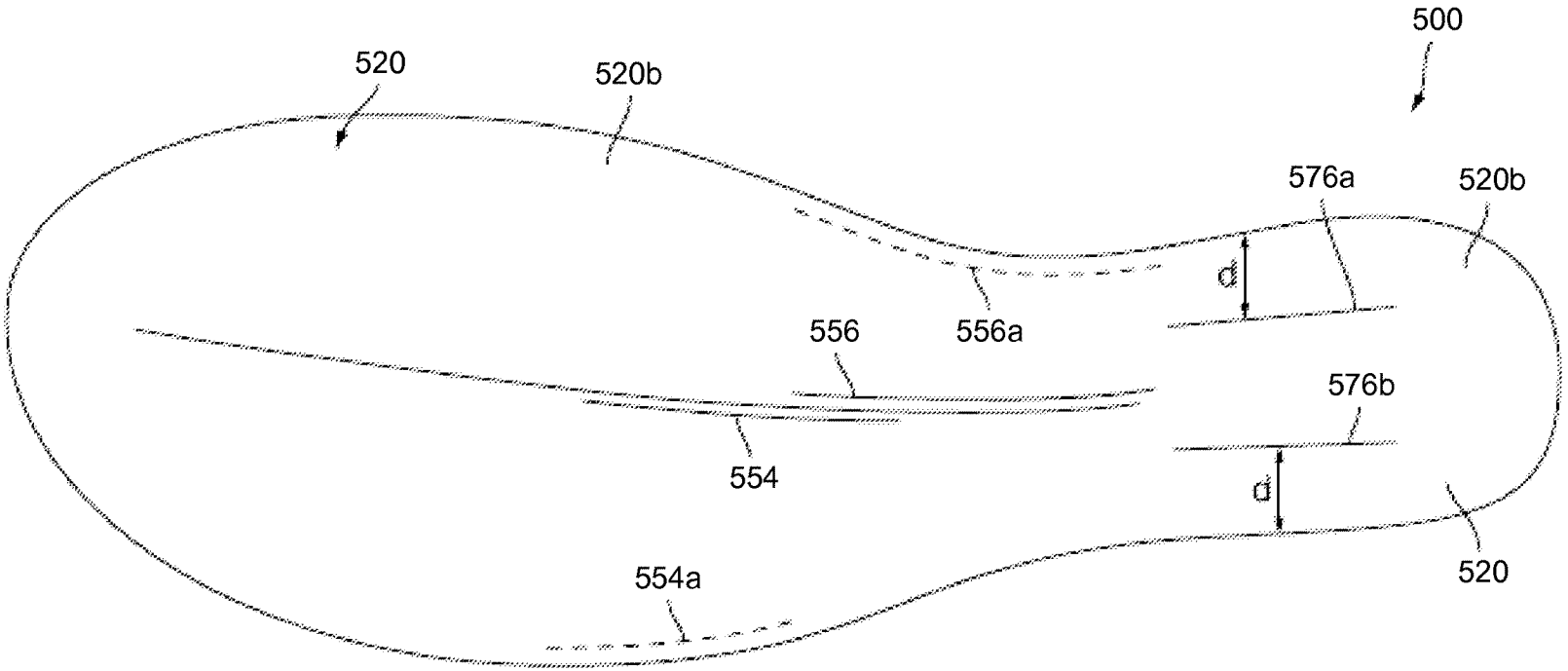

FIGS. 5A through 5C illustrate another example embodiment of a strap system that may be utilized in accordance with examples of this invention. FIGS. 5A through 5C illustrate a medial side view, a lateral side view, and a bottom view, respectively, of a bootie and strap assembly 500 that may be included in articles of footwear in accordance with at least some examples of this invention. This example assembly 500 includes a bootie portion 502, two strap securing systems 540 and 560 engaged with the bootie portion 502, and a strobel member 520 engaged with the bootie portion 502. These various parts will be described in more detail below.

The bootie portion 502 of this example assembly 500 is made from one or more pieces of textile material. While any type of textile material may be used without departing from this invention, in this illustrated example, the bootie portion 502 includes multiple layers of fabric sandwiching a spacer mesh material to provide excellent breathability. The textile and the strobel member 520 define an enclosed interior chamber 504 for receiving a user's foot (through ankle opening 506). Rather than conventional laces, lace engaging structures, and a tongue member, the instep or vamp area 508 of this example bootie portion 502 is enclosed. To allow for easy insertion of a wearer's foot, each side of the ankle opening 506 (and optionally other desired areas) in this example structure includes a stretchable or elastic portion 510. Additionally or alternatively, however, a more conventional lacing system and structure could be provided without departing from this invention.

The forefoot portion of this example bootie and strap assembly 500 includes a first strap securing system 540. This strap securing system 540 includes a first strap member 542 that extends from the lateral forefoot or midfoot area (e.g., at a location near or surrounding the wearer's little toe) somewhat diagonally across the instep or vamp area 508 to the medial midfoot area. The lateral forefoot end 544 of the first strap member 542 may be engaged between the bootie portion 502 and the strobel 520 (e.g., at the extreme lateral edge of the bootie, somewhat underneath the foot support surface, generally at the center line of the bootie (see seam 554 in FIG. 5C) or at any desired location). The second end 546 of the first strap member 542 is a free end (and may include a securing structure, such as a portion of a hook-and-loop fastener 546*a*, a portion of a buckle assembly, etc.). One end of the second strap member 548 of the first strap securing system 540 is secured at the medial midfoot area of the shoe (e.g., one end may be secured at the extreme medial edge of the bootie, somewhat underneath the foot surface, generally at the center line of the bootie (see seam 556 in FIG. 5C) or at any desired location), and the other end of the second strap member includes a tensioning element 550. As is conventional, the free end 546 of the first strap member 542 feeds through and folds around the tensioning element 550 so that the hook-and-loop fastener portion 546*a* (or other securing structure) of the free end 546 can engage a complementary securing structure (e.g., another portion of the hook-and-loop fastener, a buckle assembly, etc.) provided on the bootie or some other portion of the shoe structure (as will be described in more detail below).

Any size or dimension straps may be provided for the first strap securing system 540 without departing from this invention. If necessary or desired, as shown in FIGS. 5A and 5B, the ends of one or both of strap members 542 and 548 may be cut or split (and optionally the slit or cut may be covered with an elastic material 546*b*) to allow more natural freedom of movement in the forefoot area. Also, while this illustrated example shows the ends of strap members 542 and 548 secured generally at the center line of the bootie (see seams 554 and 556 of FIG. 5C), additionally or alternatively, they may be attached more at the side edges of the bootie (closer to where the bootie portion 502 and strobel 520 meet, e.g., at seams 554*a* and 556*a* in FIG. 5C). This arrangement can put somewhat less pressure and force on the sides of the foot when the strap securing system 540 is fully tightened and fully secured.

The rearfoot area of this example bootie and strap assembly 500 includes a second strap securing system 560, which may constitute a strap assembly of the types described above in conjunction with FIGS. 2A-4. In this illustrated example, the heel strap securing system 560 includes: a medial side junction area 562, a lateral side junction area 564, a lower medial strap component 566 that extends from the medial side junction area 562 and beneath the footbed, a lower lateral strap component 568 that extends from the lateral side junction area 564 and beneath the footbed, a rear heel strap component 570 that extends from the medial side junction area 562 to the lateral side junction area 564 to engage around a rear heel portion of a wearer's foot, an upper medial strap component 572 that extends from the medial side junction area 562 toward a medial instep area of the bootie, and an upper lateral strap component 574 that extends from the lateral side junction area 564 toward a lateral instep area of the bootie.

The upper medial strap component 572 and the upper lateral strap component 574 further may include structures for securing the strap around the wearer's foot. While any desired type of securing structure(s) may be provided without departing from this invention, in the illustrated example, the free end of the upper lateral strap component 574 includes a portion 574*a* of a hook-and-loop fastener and the free end of the upper medial strap component 572 includes a tensioning element 572*a*. As is conventional, the free end of the upper lateral strap component 574 feeds through and folds around the tensioning element 572*a* so that the hook-and-loop fastener portion 574*a* of the free end of the upper lateral strap component 574 can engage another portion 574*b* of the hook-and-loop fastener (in this illustrated example, provided on the surface of the upper lateral strap component 574). Other fastener arrangements and/or structures may be used without departing from this invention, including, for example, buckles, clamps, snaps, or other mechanical connectors.

Figure 5D:
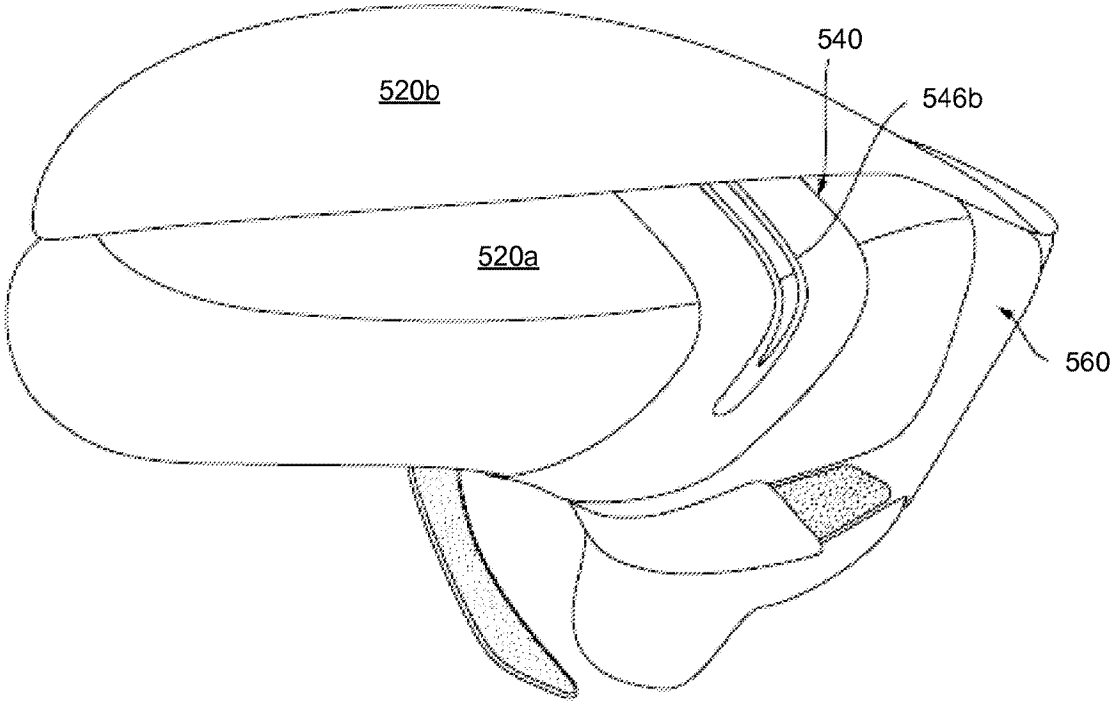

FIGS. 5C and 5D show the bottom of this example bootie and strap assembly 500. As shown, the bottom surface of the bootie and strap assembly 500 includes a first strobel layer 520*a* closing off and partially defining the foot-receiving chamber 504 and a second strobel layer 520*b*. The strobel layer(s) 520*a* and/or 520*b* may be engaged with the material of the upper 502 in any desired manner, including in conventional manners as are known and used in the art, including via sewing or stitching as shown. If desired, the strobel layer 520*a* could be replaced by or formed as a bottom surface of bootie member 502.

Portions of the strap member 540 extend between the strobel layers 520*a* and 520*b* and are engaged with the strobel layers 520*a* and 520*b* by sewn seams 554 and 556, as mentioned above. While FIG. 5C shows these seams 554 and 556 substantially along the centerline of the strobel member 520, if desired, the seams may be moved closer to the longitudinal edges of the strobel member, as shown by broken lines 554*a* and 556*a*. The seams 576*a* and 576*b* for holding the free ends of strap member 560 are located underneath the footbed so as to partially wrap around the underside of the wearer's heel. Preferably the distance d between the seams 576*a* and 576*b* (i.e., where the seams 576*a* and 576*b* are engaging and holding the strap member 560) and the side edge of the strobel member 520 will be at least 6 mm, and in some examples, at least 8 mm or even at least 10 mm. In other words, preferably the free ends of strap member 560 extend underneath the footbed and are secured underneath the footbed a distance of at least 6 mm (and in some examples, at least 8 mm or even at least 10 mm).

If desired, the free ends of the strap member 560 beneath the footbed may meet together such that a single seam can hold both straps to the strobel member 520. As yet another example, if desired, the lower medial strap component 566 that extends from the medial side junction area 562 and beneath the footbed may be formed as a single piece with the lower lateral strap component 568 that extends from the lateral side junction area 564 and beneath the footbed. In such a construction, it may be possible that no seam would be needed to engage the strap member 560 to the strobel member 520 (although a seam and engagement of these parts may be provided, if desired).

Figure 6A:
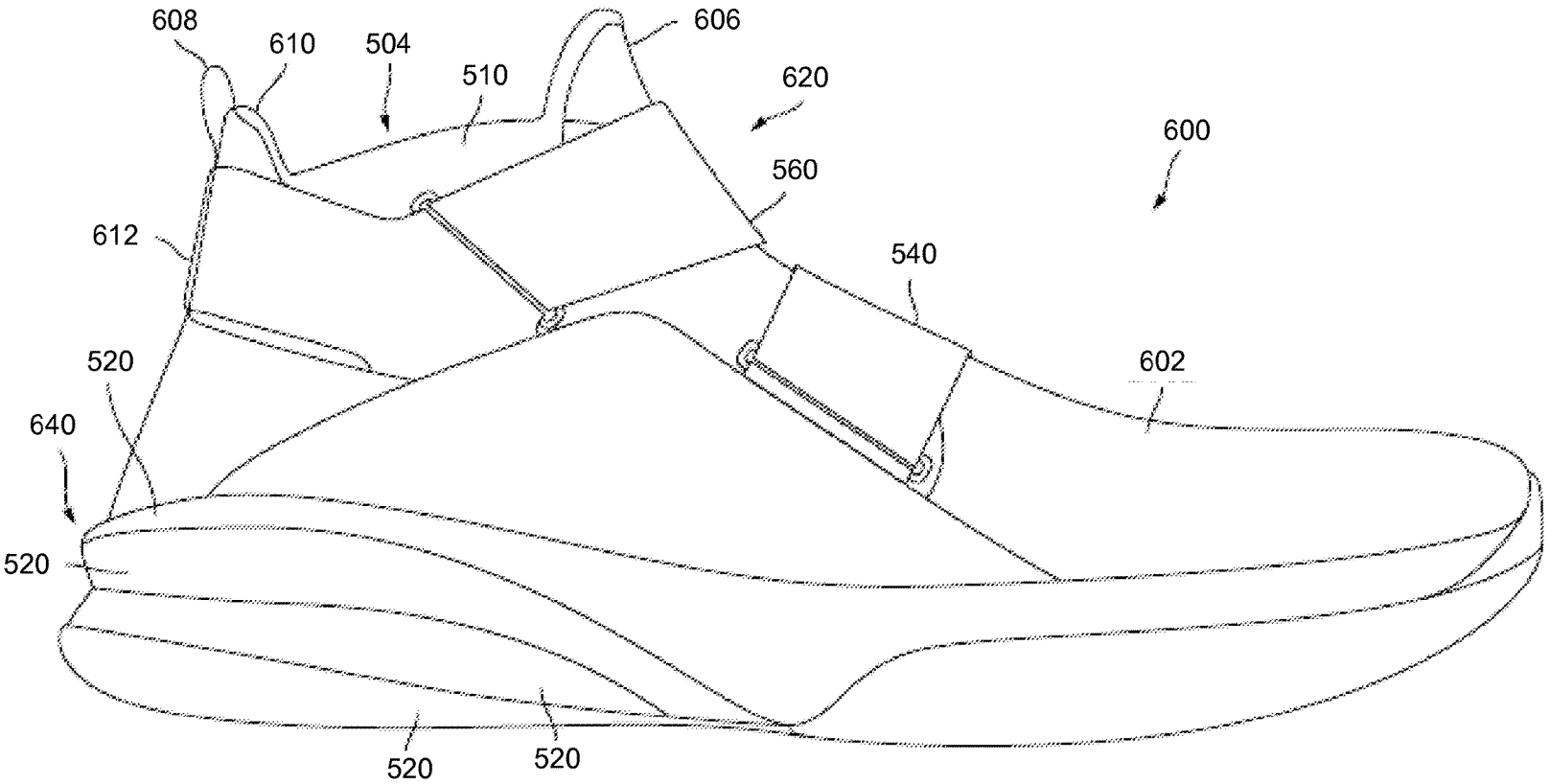
FIGS. 6A through 6C show various views of an example upper incorporating the bootie and strap construction of FIGS. 5A through 5D.
Figure 6B:
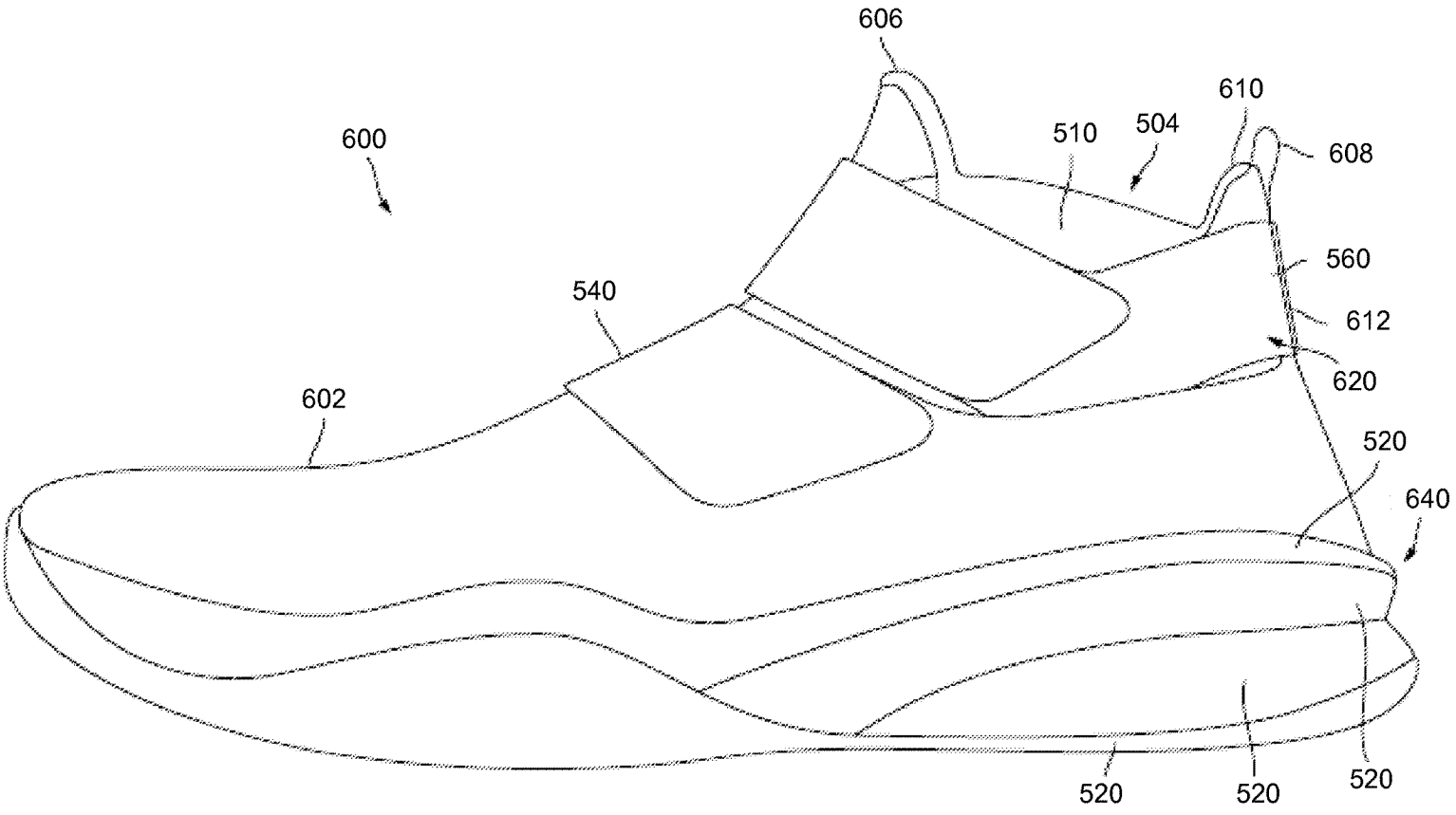
Figure 6C:
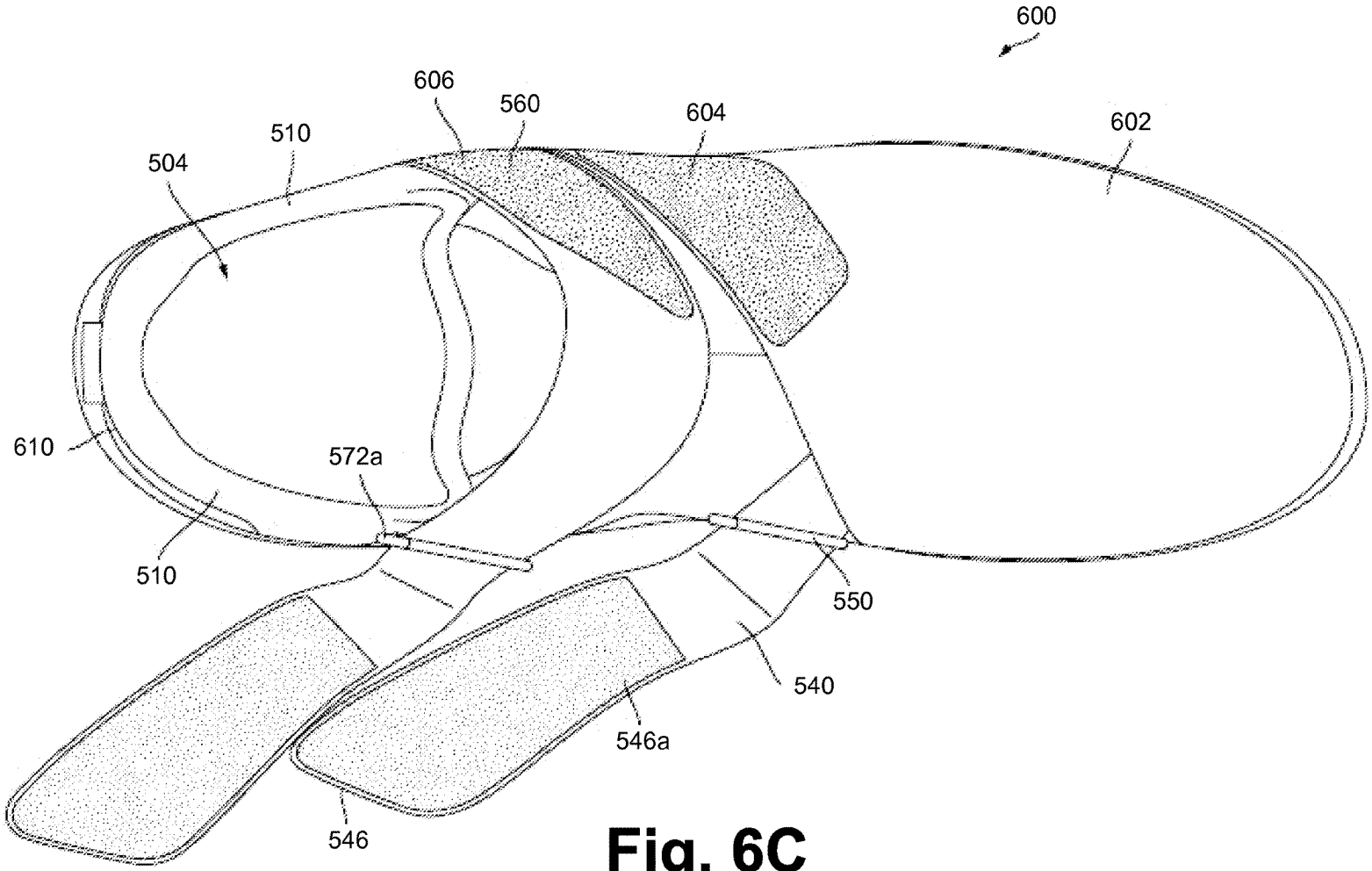

FIGS. 6A through 6C illustrate an example article of footwear 600 that includes a bootie and strap assembly 620 like that described above in conjunction with FIGS. 5A through 5D. For ease of description, the same or similar parts shown in FIGS. 6A through 6C will be labeled with the same reference numbers as used in FIGS. 5A through 5D, and much of the corresponding description of these parts and their construction will be omitted. The strap members 540 and 560 of this illustrated bootie and strap assembly 620 may be reinforced with inelastic fiber or wire elements (e.g., fibers or textile embroidered into the material of the straps 540 and 560, structures akin to the reinforcements provided in NIKE's FLYWIRE® technology, etc.).

In addition to the bootie and strap assembly 620, this example article of footwear includes a synthetic leather member 602 (including one or more component parts) that covers selective portions of the bootie and strap assembly and forms a portion of the overall footwear upper. This synthetic leather member 602 is provided to improve the durability and/or abrasion resistance of the article of footwear, and may be located at selected positions that tend to experience greater wear or impacts. As shown, in this example construction 600, the leather member 602 surrounds all or substantially all of the shoe perimeter immediately above the sole assembly 640. The leather member 602 also covers all or substantially all of the upper toe and vamp/instep portions of the bootie and strap assembly, terminating or providing an opening at the medial side so as to allow the strap member 540 to freely pass. The surface of the leather member 602 in this example includes a portion 604 of a hook-and-loop fastener that engages with the hook-and-loop fastener portion 546*a* provided at the free end 546 of strap member 540. The rear lateral side of the leather member 602 also terminates a short distance up (below the ankle area of the foot) to expose the strap member 560 of the heel and strap assembly 500. The leather member 602 also may include numerous openings (e.g., in the vamp or instep area, along the medial and lateral sides, etc.) to provide improved ventilation and breathability. Also, while the above description identifies member 602 as being made from synthetic leather, other materials also may be used without departing from this invention, such as natural leather, thermoplastic polyurethanes, other polymers or textiles, spacer meshes, etc.

As noted above, rather than a conventional lace system, the bootie and strap assembly 620 of this example includes stretchable material portions 510 along the medial and lateral sides of the shoe that enable expansion of the ankle opening 504 to a sufficient extent to allow a wearer to insert his/her foot. Also, to assist in donning the shoe 600, the front portion 606 of the ankle opening 504 includes a raised portion that can act as a handle for the user when putting on the shoe. Additionally or alternatively, if desired, a rear handle (e.g., fabric loop 608) can be provided to assist in the shoe donning process. The rear portion 610 of the ankle opening 504 also may include a raised area to which loop 608 is attached. If desired, the loop 608 also may extend downward (optionally to the leather member 602) and form a "belt-loop" type structure 612 through which a portion of the strap member 560 extends.

Relative Motion Provided by Flexible Foot Support Members

A support member that provides or supports relative heel and forefoot motion may be used in conjunction with any of the strap member configurations as described above. It may be beneficial to provide this type of relative forefoot/heel motion support member as will be described below along with a heel strap that "locks down" the heel with respect to the heel support portion of the support member. This combined structure will provide a stable fit and feel and will support more natural motion, especially when making rapid turn or cutting actions.

In at least some embodiments, a shoe can include support members for a plantar surface of a foot that include: (a) a heel support plate or surface; (b) a forefoot support plate or surface; and (c) a unidirectional hinge, wherein the hinge allows the heel support plate to rotate internally with respect to the forefoot support plate and limits an extent of external rotation of the heel support plate with respect to the forefoot support plate. The support member allows the shoe to twist and move with the foot, allowing the ankle to remain neutral, rather than the shoe fighting the foot's natural motion. The unidirectional nature of the hinge plate prevents the heel from rotating externally with respect to the forefoot beyond a certain, predetermined extent, which could result in instability of the shoe and ankle inversion.

Figure 7A:
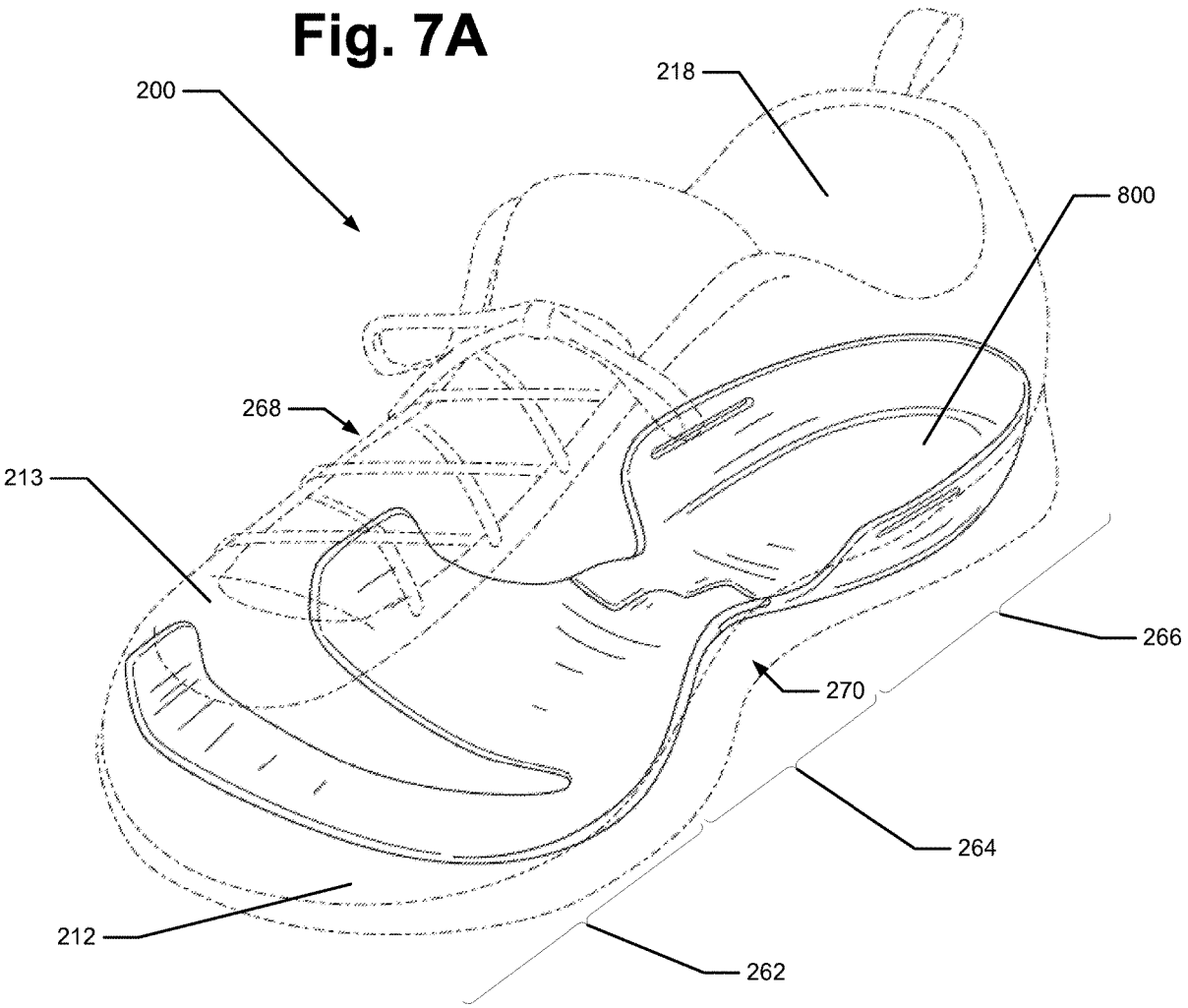
FIG. 7A illustrates an article of footwear that includes a support member according to at least some embodiments.
Figure 7B:
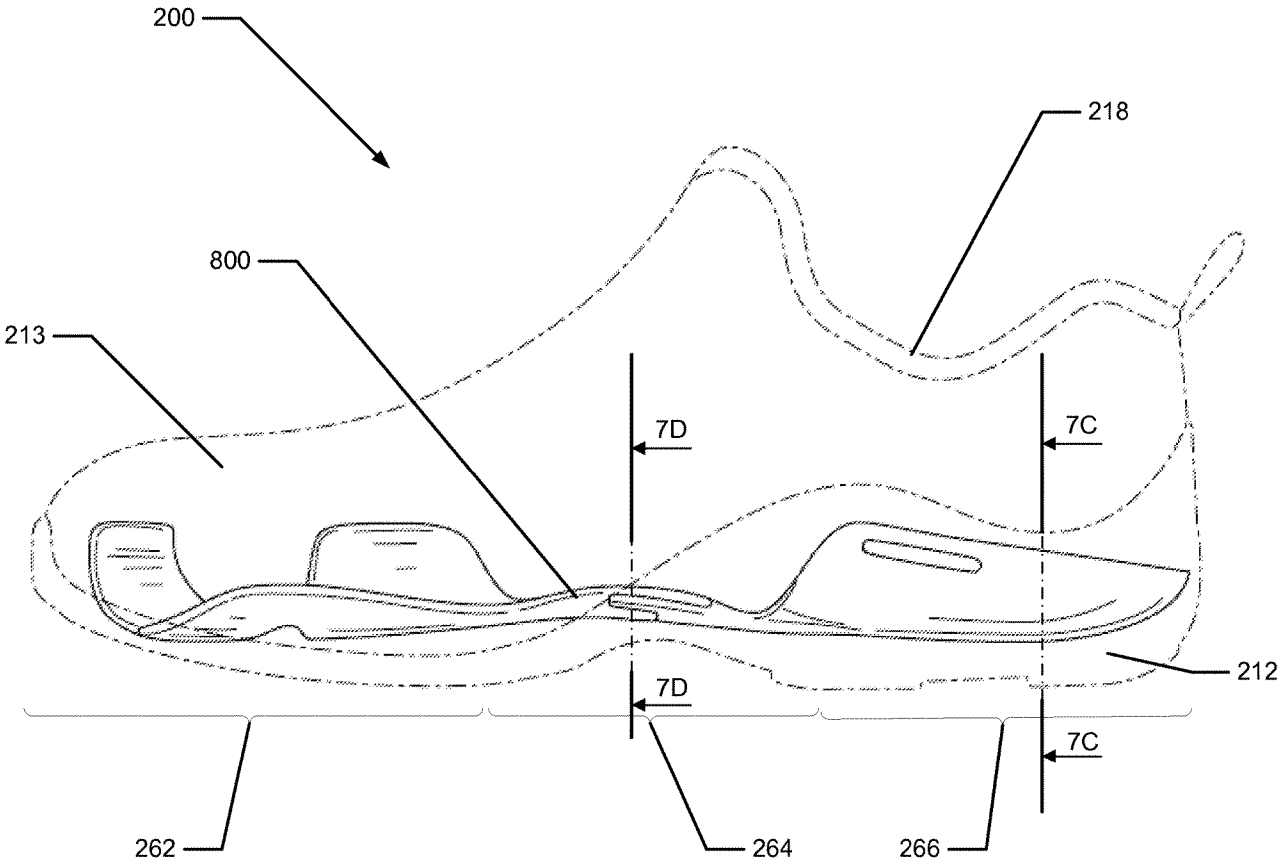
FIG. 7B illustrates a side view of the article of footwear and support member shown in FIG. 7A.

FIGS. 7A and 7B illustrate a shoe 200 that includes a support element 800 in accordance with at least some embodiments. FIG. 7A is a medial side perspective view of the support element 800. FIG. 7B is a side view of the support element 800. So as to indicate one potential location of support element 800 within the shoe 200, some parts of shoe 200 are shown in FIGS. 7A and 7B with broken lines. The shoe 200 includes a sole structure 212 and an upper 213. The upper 213 and sole structure 212 may be connected to one another in any suitable or desired manner, including in conventional manners known and used in the art, such as via adhesives or cements, via stitching or sewing, via mechanical connectors, via fusing techniques, or the like. The upper 213 forms a foot-receiving chamber into which a wearer's foot may be inserted, e.g., via opening 218. Also, as is conventional, the sole structure 212 may include a comfort-enhancing insole (not shown in FIGS. 7A and 7B), a resilient midsole member (e.g., formed, at least in part, from a polymer foam material, a fluid-filled bladder, a spring element, etc., as described above), and a ground-contacting outsole member that may provide both abrasion-resistance and traction. The shoe 200 (or other foot-receiving device structure) further may include one or more closure elements or systems of any suitable or desired type without departing from certain embodiments, including conventional closure elements and/or systems known and used in the art. Examples of such systems include: laces, zippers, buckles, hook-and-loop fasteners, etc. In at least some example embodiments, the shoe 200 may constitute an article of athletic footwear.

For purposes of reference, the shoe 200 may be divided into three general areas: a forefoot area 262, a midfoot area 264, and a heel area 266, as defined in FIGS. 7A and 7B. Areas 262-266 are intended to represent general areas of the shoe 200 that provide a frame of reference during the following discussion. Although areas 262-266 apply generally to the shoe 200, references to areas 262-266 may also apply specifically to the upper 213, the sole structure 212, or an individual component or portion within either of the upper 213 or the sole structure 212.

The various material elements forming the upper 213 and the sole structure 212, combine to form a structure having a lateral side 268 and an opposite medial side 270, as shown in FIG. 7A. The lateral side 268 extends through each of areas 262-266 and is generally configured to contact and cover a lateral surface of the foot. The medial side 270 extends through each of areas 262-266 and is generally configured to contact and cover an opposite medial surface of the foot.

Figure 7C:
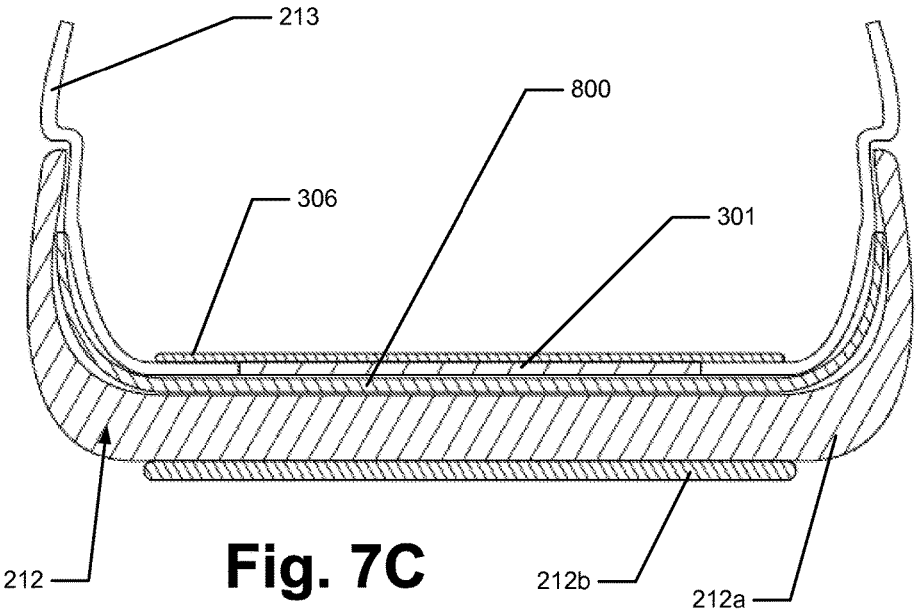
FIG. 7C illustrates a cross-section of a heel portion of the shoe with the support element shown in FIG. 7A cut approximately along line 7C-7C in FIG. 7B.
Figure 7D:
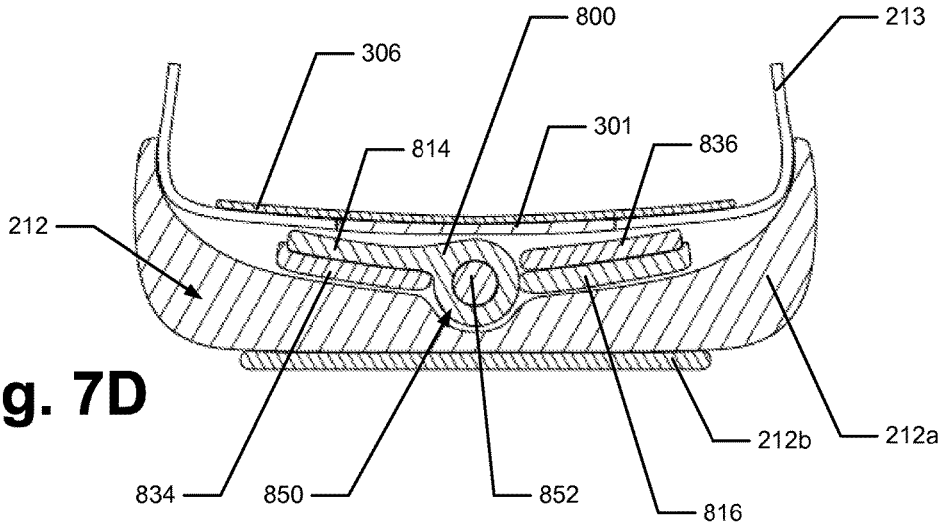
FIG. 7D shows a cross-section of an arch portion of the shoe with the support element shown in FIG. 7A cut approximately along line 7D-7D in FIG. 7B.

FIG. 7C shows a cross-section of a heel portion of the shoe 200 with a support element 800 when the wearer is standing upright on a horizontal surface cut approximately along line 7C-7C in FIG. 7B. FIG. 7D shows a cross-section of an arch portion of the shoe 200 with the support element 800 when the wearer is standing upright on a horizontal surface cut approximately along line 7D-7D in FIG. 7B. For purposes of clarification, some space has been added between adjacent elements in FIGS. 7C and 7D. In an actual shoe, some or all of that added space could be absent and elements shown to be separated in FIGS. 7C and 7D might be in direct contact. The sole structure 212 could be any of numerous widely varying types of sole structures. As one example, sole structure 212 could be a single piece molded from synthetic rubber, polyurethane or ethylvinylacetate foams, or other materials. As another example, sole structure 212 could include multiple components that have been sequentially molded or otherwise bonded or engaged together. Such a sole structure could include a midsole 212*a* formed from a first material (e.g., foamed ethylene vinyl acetate, polyurethane foam, etc.) bonded to an outsole 212*b* formed from different materials (e.g., synthetic rubber). The sole structure 212 could also include one or more fluid-filled bladders, a stiffening plate or other support element(s), traction elements (e.g., cleats), etc. In addition to the sole structure 212, FIGS. 7C and 7D show a base member 301. Base member 301 can be a strobel or other type of lasting element that joins opposite sides of the upper 213, e.g., by sewing or stitching. FIGS. 7C and 7D also show a sock liner 306 resting along the base member 301. The sock liner 306 may extend the full length of the interior of shoe 200. The sock liner 306 may similarly be unattached to sole structure 212 in the heel region, although a lower surface of liner 306 could be coated with a tacky material (e.g., a glue that does not fully cure) so as to prevent slipping between the liner 306 and the sole structure 212 in forefoot regions of shoe 200. Additionally, FIGS. 7C and 7D show the support member 800 located between the midsole 212*a* and the upper 213. If necessary or desired, any of the various footwear parts (e.g., sock liner 306, upper 213, base member 301, midsole 213*a*, outsole 212*b*, etc.) may include spaces, gaps, openings, and/or flexible materials, connections, or joints to accommodate rotation of the support member 800, as described in more detail herein. The support member 800 may be engaged with one or more of the other shoe parts at its top and/or bottom surfaces, if desired, at least at areas away from the rotational joint, As other alternatives to the structures shown in FIGS. 7C and 7D, if desired, some portion (or even all) of midsole component 212*a* (or a separate midsole component member) may be provided between the support member 800 and the upper 213/base member 301, at least at some areas of the shoe. Other arrangements and/or overall shoe constructions are possible without departing from the invention.

FIGS. 8A through 10C illustrate one example of a type of foot support member 800 in the form of a shank plate that can help provide the desired dynamic activity and help maintain a more aligned lower leg and ankle during a cutting action (a more neutral and natural orientation and/or motion of the foot). These foot support members 800 may be used to provide (or increase) an amount of internal rotation of the rearfoot with respect to the forefoot during a direction change or cutting action.

The support member 800 illustrated in FIGS. 8A through 10C provides a support for portions of a plantar surface of a wearer's foot. This shank plate type support member 800 may be provided at any desired location within a shoe construction, e.g., immediately beneath an insole or sock liner; included within or on top of a midsole component; between a midsole component and an outsole component; etc.

Figure 8A:
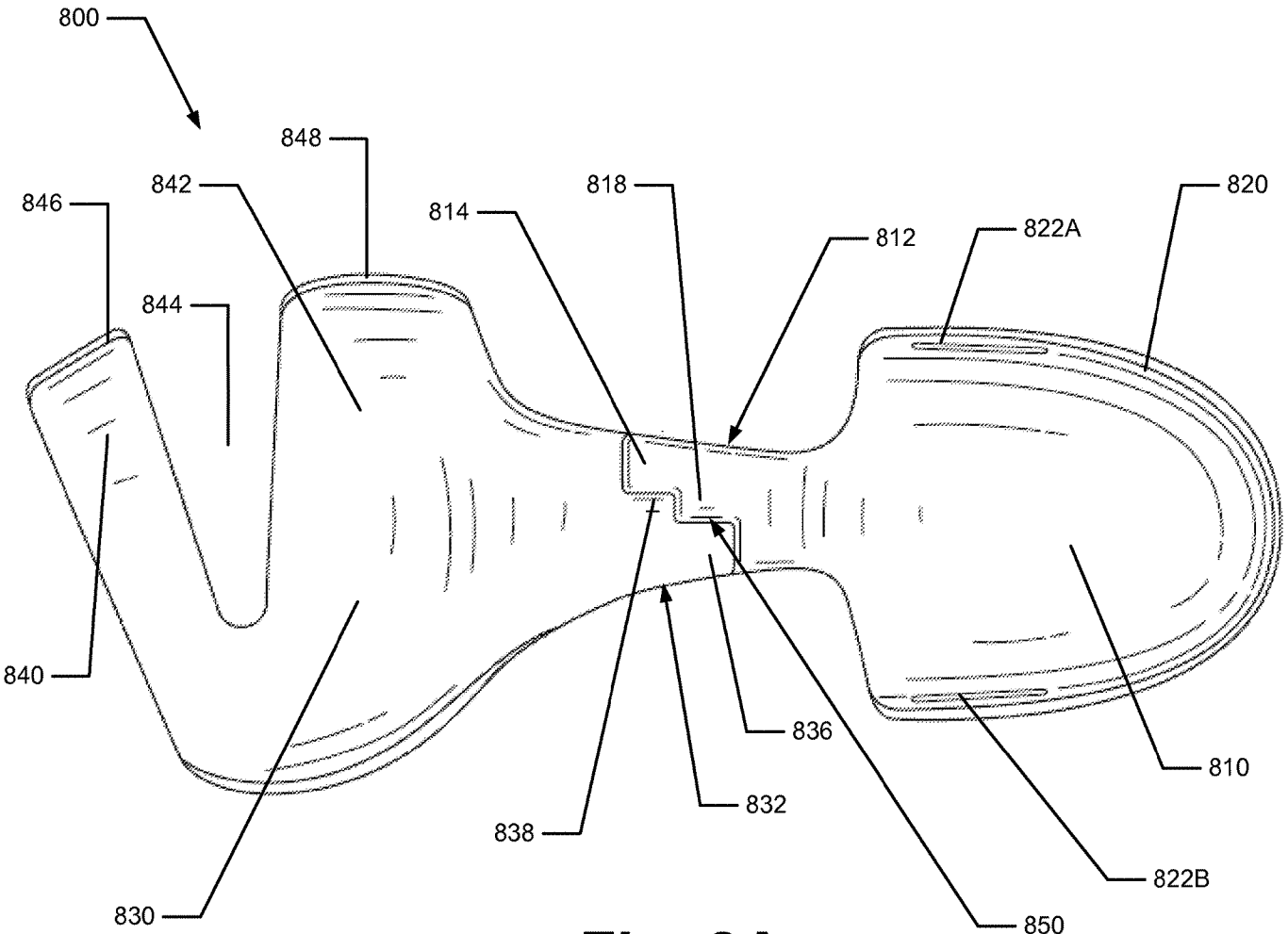
FIG. 8A illustrates a top view of a support member for supporting the plantar surface of a wearer's foot according to at least some embodiments.
Figure 8B:
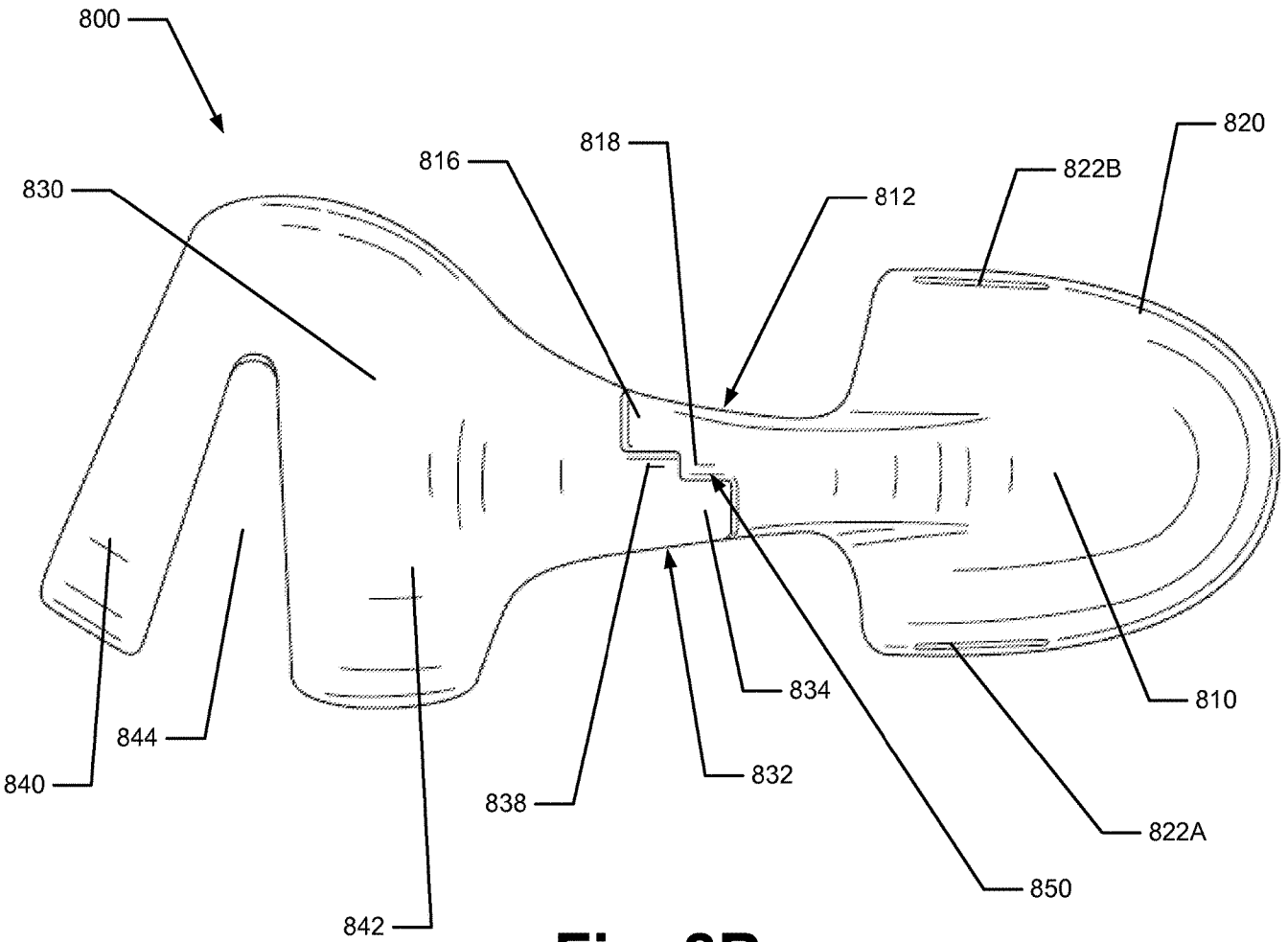
FIG. 8B illustrates a bottom view of the support member shown in FIG. 8A.
Figure 9A:
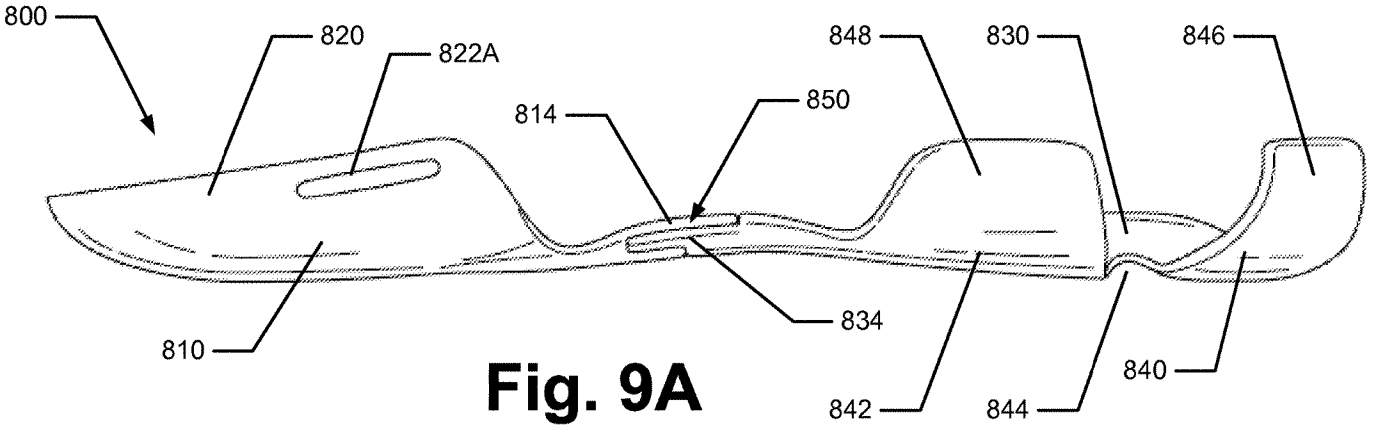
FIGS. 9A and 9B are lateral and medial views, respectively, of the support member shown in FIG. 8A.
Figure 9B:
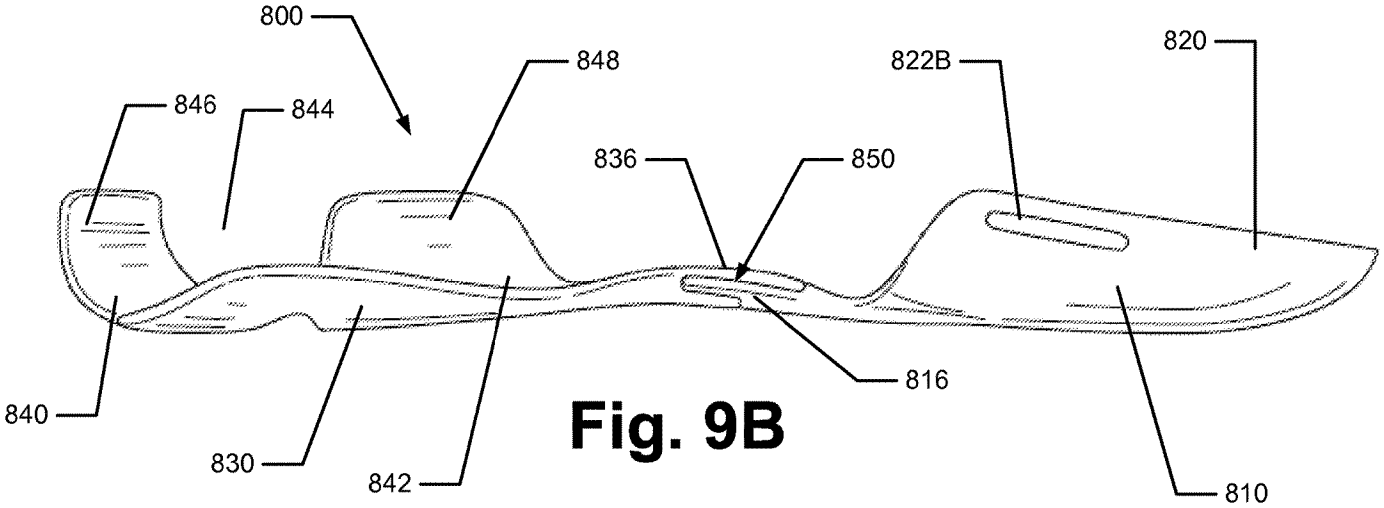
Figure 10A:
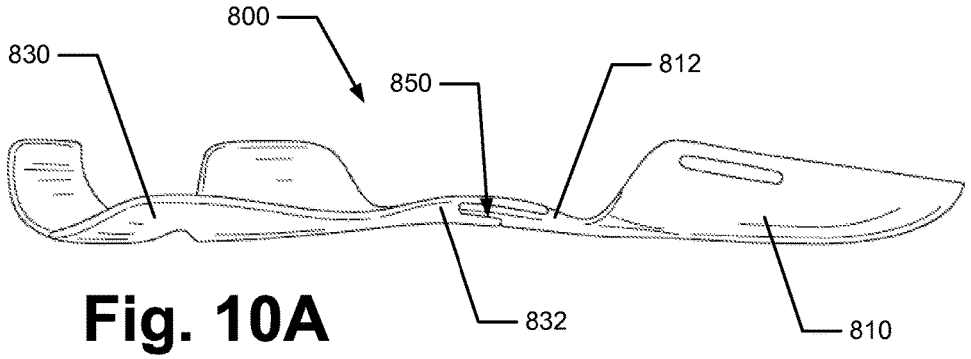
FIGS. 10A through 10C show a medial side view of various rotations of the support member illustrated in FIG. 8A.
Figure 10B:
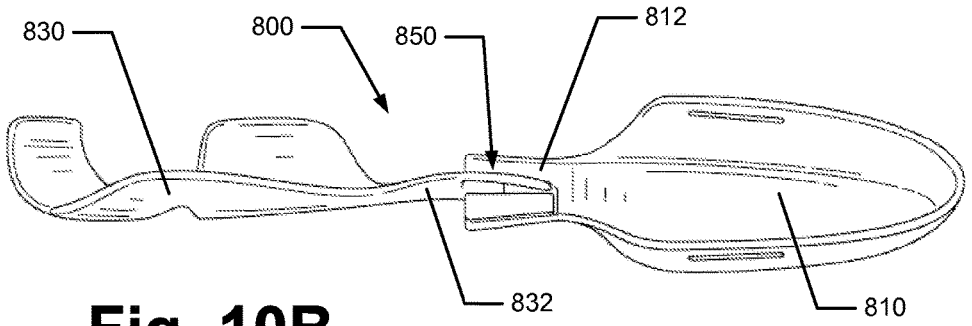
Figure 10C:
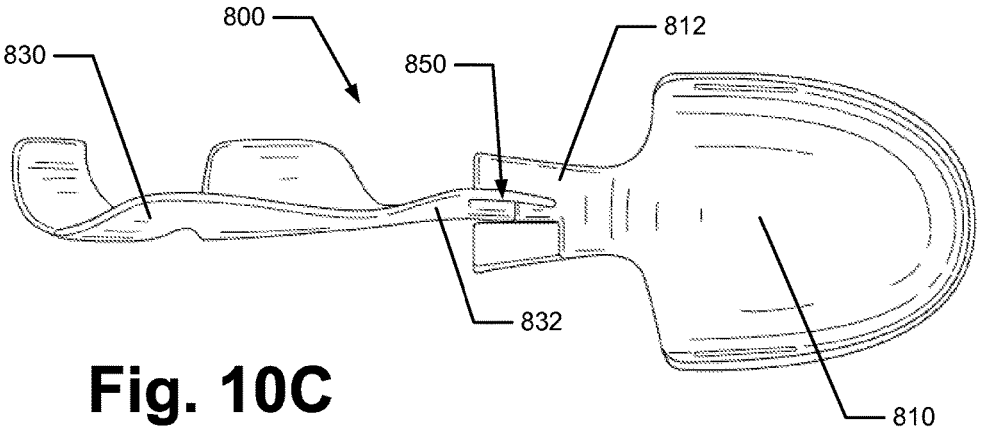

FIG. 8A shows a top view of the support member 800 for supporting the plantar surface of a wearer's foot. FIG. 8B shows a bottom view of the support member 800 illustrated in FIG. 8A. FIG. 9A shows a lateral side view and FIG. 9B shows a medial side view of the support member 800 illustrated in FIG. 8A. FIGS. 10A through 10C show a medial side view of various stages of rotations of the support member 800 illustrated in FIG. 8A. The support member 800 includes a heel support plate 810 and a forefoot support plate 830. The heel support plate 810 and the forefoot support plate 830 may be fixed to each other or engaged with each other by a unidirectional hinge 850 as will be described in detail further below. The various plates and members of the support member 800 may be made from any desired materials without departing from this invention, including metals, metal alloys, polymers, composite materials, fiber-reinforced materials, and the like (e.g., rigid polymeric materials), provided the various regions and members as constructed are capable of functioning in the manner described in more detail below. Also, the support member 800 may be made of any number of individual parts without departing from this invention, including a two-piece construction as shown in FIGS. 7A through 10C.

In this illustrated example structure 800, the heel support plate 810 is located in the heel area 266 of the shoe 200, extending from the heel area 266 to the midfoot area 264 of the shoe 200. The heel support plate 810 includes a heel hinge region 812. The heel hinge region 812 may include a lateral wing 814, a medial wing 816, and a heel hinge member or area 818. The heel lateral wing 814 may extend from the heel support plate 810 on the lateral side of the shoe, and it may be generally located in a midfoot region of the shoe. The heel lateral wing 814 may be generally rectangular or square in shape. The heel lateral wing 814 may also be other shapes without departing from the invention. Opposite of the heel lateral wing 814, the heel medial wing 816 may extend from the heel support plate 810 on the medial side of the shoe, and it may be generally located in a midfoot region of the shoe. The heel medial wing 816 may be generally rectangular or square in shape. The heel medial wing 816 may also be other shapes without departing from the invention. The heel hinge member or area 818 may be located between the heel lateral wing 814 and the heel medial wing 816. The heel hinge member or area 818 may interface and engage a portion of the forefoot hinge member or area 838 as will be described further below.

Additionally, in this illustrated example structure 800, the forefoot support plate 830 is located in the forefoot area 262 of the shoe 200, extending from the forefoot area 262 to the midfoot area 264 of the shoe 200. The forefoot support plate 830 includes a forefoot hinge region 832. The forefoot hinge region 832 may include a lateral wing 834, a medial wing 836, and a forefoot hinge member or area 838. The forefoot lateral wing 834 may extend from the forefoot support plate 830 on the lateral side of the shoe, and it may be located in the midfoot area of the shoe. The forefoot lateral wing 834 may be generally rectangular or square in shape. The forefoot lateral wing 834 may also be other shapes without departing from the invention. Opposite of the forefoot lateral wing 834, the forefoot medial wing 836 may extend from the forefoot support plate 830 on the medial side of the shoe, and it also may be located in the midfoot area of the shoe. The forefoot medial wing 836 may be generally rectangular or square in shape, although it may also be other shapes without departing from the invention. The forefoot hinge member or area 838 may be located between the forefoot lateral wing 834 and the forefoot medial wing 836. The forefoot hinge member or area 838 may interface and engage a portion of the heel hinge member or area 818 as will be described further below.

Figure 11A:
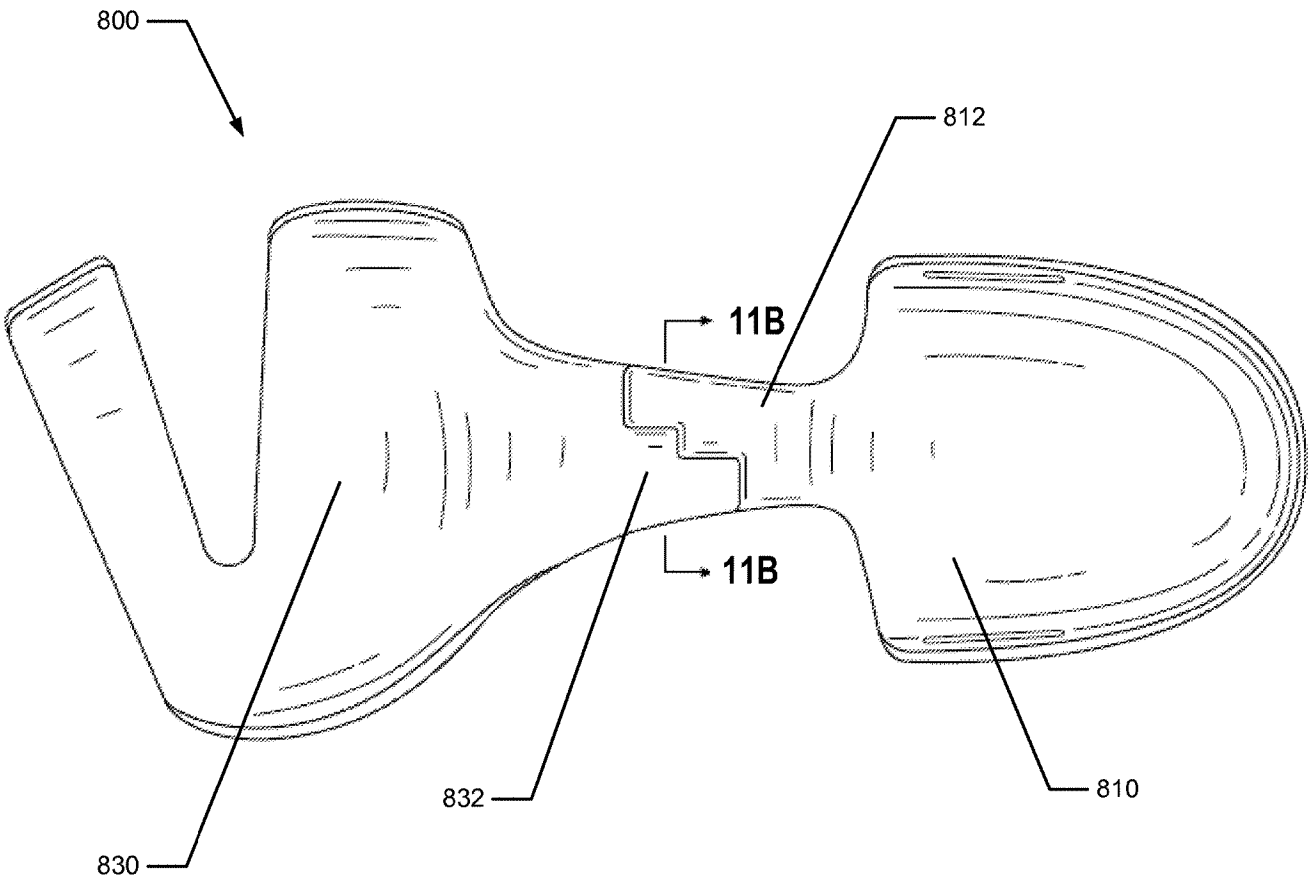
FIG. 11A illustrates a top view of a support member showing the cross-section location of a unidirectional hinge for FIGS. 11B through 11D according to at least some embodiments.
Figure 11B:
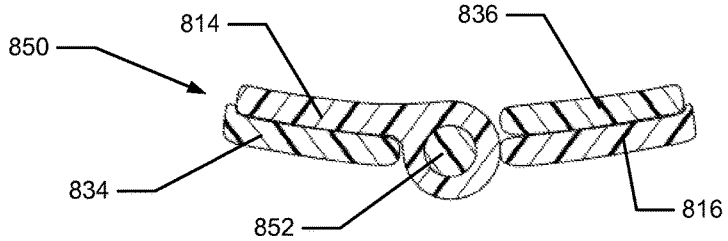
FIGS. 11B through 11D illustrate cross-sectional views of the rotation of the unidirectional hinge shown in FIG. 11A.
Figure 11C:
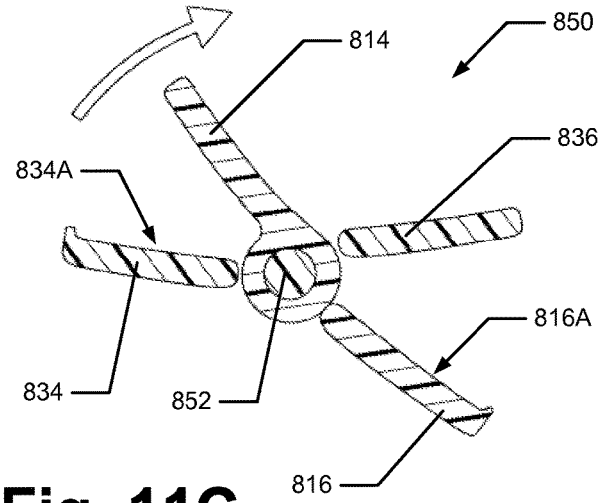
Figure 11D:
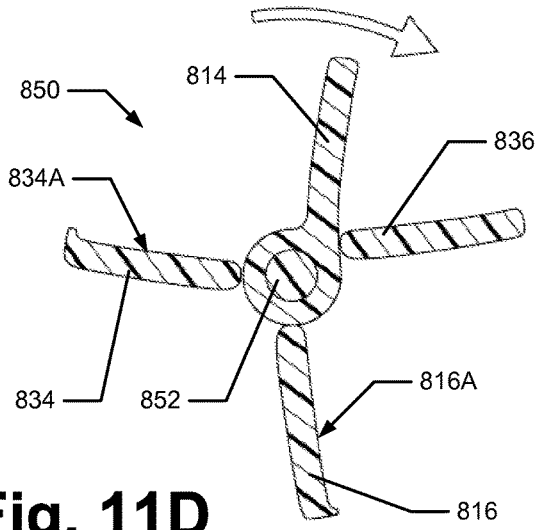

In some example structures according to this aspect of the invention, including the one illustrated in FIGS. 7D and 11B through 11D, the unidirectional hinge 850 may include one or more recesses provided for receiving the overlapping portion of an opposing wing. For example, the heel medial wing 816 may include a recess 816A located on a top surface of the wing 816. This recess 816A may be provided for receiving the overlapping portion of a bottom surface of a forefoot medial wing 836 when the hinge is in a fully closed position (see FIG. 11B). Optionally, if desired (and as shown in FIGS. 11B through 11D), an end of the heel medial wing 816 may be made somewhat thinner at the very end (e.g., at least at the overlapping portion). In this manner, when the user stands on the shoe in an upright manner, the bottom of the overall shank member structure 800 is flush or substantially flush (e.g., smoothly contoured) at the overlapping portion. As alternatives, if desired, the recessed or thinned area may be provided only on the bottom surface of the heel lateral wing 814 for receiving the overlapping portion of a top surface of a forefoot lateral wing 834. As yet another alternative, if desired, no recessed portion need be provided (or indeed, no overlapping portion need be provided). The recessed portion(s), when present, may be closely dimensioned to substantially match the shape of the overlapping area(s), or the recessed portion(s) may be somewhat or even substantially larger than the overlapping area(s).

Additionally, in some example structures according to this aspect of the invention, including the one illustrated in FIGS. 11B through 11D, the unidirectional hinge 850 may include one or more recesses provided for receiving the overlapping portion of an opposing wing. For example, the forefoot lateral wing 834 may include a recess 834A located on a top surface of the wing 834. This recess 834A may be provided for receiving the overlapping portion of a bottom surface of a heel lateral wing 814 when the hinge is in a fully closed position (see FIG. 11B). Optionally, if desired (and as shown in FIGS. 11B through 11D), an end of the forefoot lateral wing 834 may be made somewhat thinner at the very end (e.g., at least at the overlapping portion). In this manner, when the user stands on the shoe in an upright manner, the bottom of the overall shank member structure 800 is flush or substantially flush (e.g., smoothly contoured) at the overlapping portion. As alternatives, if desired, the recessed or thinned area may be provided only on the bottom surface of the forefoot medial wing 836 for receiving the overlapping portion of a top surface of a heel medial wing 816. As yet another alternative, if desired, no recessed portion need be provided (or indeed, no overlapping portion need be provided). The recessed portion(s), when present, may be closely dimensioned to substantially match the shape of the overlapping area(s), or the recessed portion(s) may be somewhat or even substantially larger than the overlapping area (s).

Also, in this illustrated example structure 800, the heel support plate 810 is fixed to the forefoot support plate 830 by joining two separate members together in any desired manner, such as via the unidirectional hinge 850 or other mechanical connectors. Additionally, this illustrated example structure 800 includes a unidirectional hinge 850. FIG. 11A illustrates a top view of the support member 800 for supporting the plantar surface of a wearer's foot showing the cross-section location for the views of FIGS. 11B through 11D. FIGS. 11B through 11D illustrate cross-sectional views of the unidirectional hinge 850 in operation from no rotation (FIG. 11B) to full rotation (FIG. 11D). The unidirectional hinge 850 may be located in the midfoot section and allows the heel support plate 810 to rotate internally with respect to the forefoot support plate 830. The hinge 850 may include portions of the heel support plate 810, such as the lateral heel wing 814 and the medial heel wing 816. The hinge 850 may also include portions of the forefoot support plate 830, such as the lateral forefoot wing 834 and the medial forefoot wing 836. The hinge 850 may also include the interaction areas of the heel hinge member 818 and the forefoot hinge member 838. Additionally, the hinge 850 may include a connecting member 852 that connects or holds the heel support plate 810 and the forefoot support plate 830 together. The connecting member 852 may also provide the rotating means for the hinge 850 such that the heel support plate 810 and the forefoot support plate 830 are allowed to rotate with respect to one another. The connecting member 852 may be in the form of a pin or post engaged with and extending between the heel hinge member 818 and the forefoot hinge member 838. One or both of the heel hinge member 818 and/or the forefoot hinge member 838 may include a hole for receiving the connecting member 852 to help facilitate the connection and/or the rotation of the heel support plate 810 with respect to the forefoot support plate 830. As another option, if desired, the connecting member 852 may be integrally formed with one of hinge members 818 or 838, and this connecting member 852 may extend into a hole or receptacle formed in the other hinge member.

In operation, and as illustrated in FIGS. 11A through 11D, the unidirectional hinge 850 allows the heel portion of the support member 800 to rotate internally, while preventing the heel portion of the support member 800 from over-rotating externally. FIG. 11B illustrates the hinge 850 at no rotation. As illustrated in FIG. 11B, the heel lateral wing 814 is engaged with and on top of the forefoot lateral wing 834, with the heel lateral wing 814 sitting in the forefoot lateral wing recess 834A. Additionally, the forefoot medial wing 836 is engaged with and on top of the heel medial wing 816, with the forefoot medial wing 836 sitting in the heel medial wing recess 816A. FIGS. 11C and 11D illustrate the hinge 850 rotating, and thus the heel support plate 810 rotating internally. As illustrated in FIGS. 11C and 11D, the heel lateral wing 814 and the heel medial wing 816 rotate counterclockwise from the forefoot lateral wing 834 and the forefoot medial wing 836 respectively. FIG. 11C shows a partial rotation of the hinge 850, while FIG. 11D shows a full rotation of the hinge 850 (although other features of the shoe structure and/or human foot anatomy may prevent internal rotation to the full extent shown in FIG. 11D). FIG. 11B also illustrates how the hinge 850 can stop rotation in the opposite direction (e.g., stopping external rotation beyond the orientation shown in FIG. 11B). Because of the construction of the interfacing wings, the hinge 850 can freely rotate internally (clockwise in FIGS. 11B-11D), but it is only permitted to rotate counterclockwise (in FIGS. 11B-11D) to the limited extent shown in FIG. 11B. The overlapping and interfacing (contacting) wings 814, 816, 834, 836 limit rotation in the counterclockwise direction.

As noted above, the support member 800 may be made from rigid materials (e.g., a relatively hard plastic) that still provide some flexibility. In use, as a user wearing a shoe incorporating this support structure 800 steps down hard on the medial side of an outside foot (e.g., to make a rapid, hard turn or a cutting action), the heel support plate 810 can rotate internally to support a more neutral and natural lower leg/ankle orientation and/or motion. As discussed above, the heel support plate 810 is limited by the interfacing wings and overlap of the wings to prevent excessive external rotation, which could result in instability of the shoe and ankle inversion.

Support members 800 of this type may include various additional features that enhance their flexibility, comfort, and use. For example, as illustrated in FIGS. 8A and 8B, in at least some example structures according to this aspect of the invention, the forefoot support plate includes a first lateral wrap member 840 and a second lateral wrap member 842. The lateral wrap member(s) may extend from a middle or ball portion of the forefoot support plate 830 toward the lateral side. As illustrated in FIGS. 8A and 8B, the first lateral wrap member 840 and the second lateral wrap member 842 are separated from one another by a space 844. This space 844 can help improve the feel and reduce the stiffness of the forefoot support plate 830, particularly as the foot rolls forward from rear to front during the push off (rearward thrust off the ball or toe of the foot) and toe-off phases of a step cycle and as the foot contacts the ground during a direction change or cutting action, as described above. Adjusting the widths (in the front-to-back direction) and/or the thicknesses (in the top-to-bottom direction) of the first lateral wrap member 840 and the second lateral wrap member 842, at least in part, also can allow the manufacturer to control the overall flexibility and stiffness of the forefoot plate 830 of the support member 800. Additionally, each of the lateral wrap members 840 842 may include a raised side wall 846, 848 anatomically located with respect to the user's foot to engage and help provide support to the lateral side surface of the foot during cutting (e.g., to help hold the lateral side of the foot on the sole structure as the sideways force is applied to the foot during a cutting action).

Various additional areas of the support member 800, and particularly the heel area, include raised side walls that help support the foot and maintain the foot's position during use of a shoe, including during a hard turn or cutting maneuver. Note, for example, as illustrated in FIGS. 9A and 9B: a raised perimeter wall 820 at a rear heel area of the heel support plate 810 (extending around the rear heel area of the heel support plate 810 from a medial side area to a lateral side area of the heel support plate 810). The heel raised side wall 820 can help provide additional heel support and help maintain the position of the wearer's heel, e.g., similar to a conventional heel counter structure.

While all of these side walls 820, 846, and 848 are shown in the example structure 800, one or more (or all) of these side walls could be omitted without departing from this invention (and optionally replaced with a side support as part of another component of the article of footwear). Also, while these side walls may be raised up from the plantar support surface immediately adjacent to them by any desired height without departing from this invention, in the illustrated example, for men's shoes (e.g., sizes about 9 to 13), these walls will be raised up at their highest points from about 2 mm to about 35 mm (e.g., from 2 to 20 mm in the forefoot area and from 5 to 35 mm (or even more, if desired) in the heel area).

Additionally, the raised perimeter wall 820 at a rear heel area of the heel support plate 810 may include one or more slots 822A, 822B. For example, as illustrated in FIGS. 9A and 9B, the heel support flange 820 may include a first slot 822A located on the lateral side and a second slot 822B located on the medial side. The one or more slots 822A, 822B may be utilized for receiving the straps of the heel strap as detailed above, such that the heel strap could extend to hold the heel support plate 810 with the strap, upper, etc. The heel straps could be located inside the top of the heel support plate 810, then extend through the slots 822A, 822B, and then wrap around the bottom (outside) of the heel support plate 810. In another example, the heel straps could be on the outside at the top of the heel support plate 810, then extend through the slots 822A, 822B, and then along the inside of the heel support plate 810. The heel straps may be fixed (e.g., glued) at the bottom of the heel support plate 810, if desired.

As noted above, the support member 800 illustrated in FIGS. 7A through 11D provides a support for a plantar surface of a wearer's foot, and this shank plate type support member 800 may be provided at any desired location within a shoe construction, e.g., immediately beneath an insole or sock liner; included within or on top of a midsole component; between a midsole component and an outsole component; etc. If necessary or desired, modifications may be made to other components of the footwear structure to accommodate the motion, as described above. For example, if desired, the outsole of a shoe including this support member 800 also may be detached or include a gap or flexible joint at the arch area, e.g., to allow more free rotation of the overlapping portion between the heel support plate 810 and the forefoot support plate 830 so that the outsole can flex or move in the desired manner to support the movement of the interfacing wings of the heel support plate 810. As another example, if desired, the midsole, insole, sockliner, and/or the like may include a gap, slit, other detachment, a stretchable material, and/or a flexible joint at the area of the overlapping portion (and optionally rearward thereof) to help accommodate movement of the interfacing wings of the heel support plate 810 with respect to the forefoot support plate 830. As still another example, if desired, the outsole, midsole, insole, sockliner, and/or the like may include an elastic component or element at the area of the overlapping portion and extending rearward from the overlapping portion to help accommodate movement of the interfacing wings of the heel support plate 810 with respect to the forefoot support plate 830. Other constructions or combinations of the above constructions may be provided without departing from this invention.

In addition to articles of footwear, aspects of this invention can be practiced with other types of "foot-receiving devices" (i.e., any device into which a user places at least some portion of his or her foot). In addition to all types of footwear or shoes (e.g., as described above), foot-receiving devices include, but are not limited to: boots, bindings and other devices for securing feet in snow skis, cross country skis, water skis, snowboards, and the like; boots, bindings, clips, or other devices for securing feet in pedals for use with bicycles, exercise equipment, and the like; boots, bindings, clips, or other devices for receiving feet during play of video games or other games; and the like. Such foot-receiving devices may include: (a) a foot-covering component (akin to a footwear upper) that at least in part defines an interior chamber for receiving a foot; and (b) a foot-supporting component (akin to the footwear sole structure) engaged with the foot-covering component. Structures for providing the desired relative rearfoot movement with respect to the forefoot, as described above, may be incorporated in the foot-covering and/or foot-supporting component of any desired type of foot-receiving device.

The foregoing description of embodiments has been presented for purposes of illustration and description. The foregoing description is not intended to be exhaustive or to limit embodiments of the present invention to the precise form disclosed, and modifications and variations are possible in light of the above teachings or may be acquired from practice of various embodiments. The embodiments discussed herein were chosen and described in order to explain the principles and the nature of various embodiments and their practical application to enable one skilled in the art to utilize the present invention in various embodiments and with various modifications as are suited to the particular use contemplated. Any and all combinations, subcombinations and permutations of features from above-described embodiments are the within the scope of the invention. With regard to claims directed to an apparatus, an article of manufacture or some other physical component or combination of components, a reference in the claim to a potential or intended wearer or a user of a component does not require actual wearing or using of the component or the presence of the wearer or user as part of the claimed component or component combination.

The invention claimed is:

1. A support member for a plantar surface of a foot, comprising:

a heel support plate that includes a heel plantar support surface, a heel lateral wing, and a heel medial wing, wherein the heel lateral wing extends from a lateral side of the heel support plate and the heel medial wing extends from a medial side of the heel support plate;

a raised perimeter side wall extending upward from the heel plantar support surface and around a rear heel area of the heel support plate from the lateral side of the heel support plate to the medial side of the heel support plate;

a forefoot support plate that includes a forefoot lateral wing and a forefoot medial wing, wherein the forefoot lateral wing extends from a lateral side of the forefoot support plate and the forefoot medial wing extends from a medial side of the forefoot support plate, wherein the forefoot support plate further includes: (a) a forefoot plantar support surface, (b) a first lateral wrap extending from a ball portion of the forefoot support plate toward the lateral side of the forefoot support plate, wherein an outside perimeter edge of the first lateral wrap includes a first raised side wall extending upward from the forefoot plantar support surface, wherein the first raised side wall is configured to engage and support a lateral side surface of a wearer's foot, and (c) a second lateral wrap extending from the ball portion of the forefoot support plate toward the lateral side of the forefoot support plate, wherein an outside perimeter edge of the second lateral wrap includes a second raised side wall extending upward from the forefoot plantar support surface, wherein the second raised side wall is configured to engage and support the lateral side surface of a wearer's foot; and a strap system, wherein the strap system includes an ankle strap, a lateral heel strap and a medial heel strap, and wherein the strap system is configured such that, when the support member is engaged with a foot of a human wearer, the ankle strap completely surrounds and is secured to the wearer's ankle, the lateral heel strap extends from under a wearer's lateral malleolus to a lateral anchor location under a heel of the wearer's foot, and the medial heel strap extends from under a wearer's medial malleolus to a medial anchor location under the heel of the wearer's foot, wherein interaction of the heel medial wing and the heel lateral wing of the heel support plate and the forefoot medial wing and the forefoot lateral wing of the forefoot support plate allows the heel support plate to rotate internally with respect to the forefoot support plate and limits the heel support plate from rotating externally beyond a predetermined extent with respect to the forefoot support plate.

2. The support member according to claim 1, wherein the raised perimeter side wall includes a medial slot defined therein configured to receive the medial heel strap and a lateral slot defined therein configured to receive the lateral heel strap.

3. The support member according to claim 1, wherein the heel support plate is formed as a unitary, one-piece construction with the heel lateral wing and the heel medial wing and the forefoot support plate is formed as a unitary, one-piece construction with the forefoot lateral wing and the forefoot medial wing.

4. The support member according to claim 1, wherein each of the heel support plate and the forefoot support plate is formed as one or more pieces from a rigid polymeric material.

5. The support member according to claim 1, wherein the heel lateral wing overlaps the forefoot lateral wing and the forefoot medial wing overlaps the heel medial wing.

6. The support member according to claim 5, wherein a top surface of the forefoot lateral wing includes a recessed area for receiving an overlapping portion of a bottom surface of the heel lateral wing.

7. The support member according to claim 5, wherein a top surface of the heel medial wing includes a recessed area for receiving an overlapping portion of a bottom surface of the forefoot medial wing.

8. The support member according to claim 5, wherein the heel lateral wing can rotate in a direction away from the forefoot lateral wing but rotation of the heel lateral wing in a direction toward the forefoot lateral wing is limited by the overlap between the heel lateral wing and the forefoot lateral wing.

9. The support member according to claim 5, wherein the heel medial wing can rotate in a direction away from the forefoot medial wing but rotation of the heel medial wing in a direction toward the forefoot medial wing is limited by the overlap between the heel medial wing and the forefoot medial wing.

10. A support member for a plantar surface of a foot, comprising:

a heel support plate that includes a heel lateral wing and a heel medial wing, wherein the heel lateral wing extends from a lateral side of the heel support plate and the heel medial wing extends from a medial side of the heel support plate;

a forefoot support plate that includes a forefoot lateral wing and a forefoot medial wing, wherein the forefoot lateral wing extends from a lateral side of the forefoot support plate and the forefoot medial wing extends from a medial side of the forefoot support plate, wherein the forefoot support plate further includes: (a) a forefoot plantar support surface, (b) a first lateral wrap extending from a ball portion of the forefoot support plate toward the lateral side of the forefoot support plate, wherein an outside perimeter edge of the first lateral wrap includes a first raised side wall extending upward from the forefoot plantar support surface, wherein the first raised side wall is configured to engage and support a lateral side surface of a wearer's foot, and (c) a second lateral wrap extending from the ball portion of the forefoot support plate toward the lateral side of the forefoot support plate, wherein an outside perimeter edge of the second lateral wrap includes a second raised side wall extending upward from the forefoot plantar support surface, wherein the second raised side wall is configured to engage and support the lateral side surface of a wearer's foot; and a strap system, wherein the strap system includes an ankle strap, a lateral heel strap and a medial heel strap, and wherein the strap system is configured such that, when the support member is engaged with a foot of a human wearer, the ankle strap completely surrounds and is secured to the wearer's ankle, the lateral heel strap extends from under a wearer's lateral malleolus to a lateral anchor location under a heel of the wearer's foot, and the medial heel strap extends from under a wearer's medial malleolus to a medial anchor location under the heel of the wearer's foot, wherein interaction of the heel medial wing and the heel lateral wing of the heel support plate and the forefoot medial wing and the forefoot lateral wing of the forefoot support plate allows the heel support plate to rotate internally with respect to the forefoot support plate and limits the heel support plate from rotating externally beyond a predetermined extent with respect to the forefoot support plate.

11. The support member according to claim 10, wherein the first lateral wrap and the first raised side wall are separated from the second lateral wrap and the second raised side wall by a space extending inward from the lateral side of the forefoot support plate between the first raised side wall and the second raised side wall.

12. The support member according to claim 10, wherein the heel support plate further includes a heel plantar support surface, and wherein the support member further comprises a raised perimeter side wall extending upward from the heel plantar support surface and around a rear heel area of the heel support plate.

13. The support member according to claim 10, wherein each of the first raised side wall and the second raised side wall has a height at its highest point from 2 mm to 35 mm from the forefoot plantar support surface.

14. The support member according to claim 1, wherein the raised perimeter side wall has a height at its highest point from 5 mm to 35 mm from the heel plantar support surface.

15. The support member according to claim 1, wherein the strap system is asymmetric.

16. The support member according to claim 1, wherein:

each of the lateral heel strap and the medial heel straps includes a forward and a rear edge, the strap system is configured such that at least part of the lateral heel strap forward edge and at least part of the medial heel strap forward edge are rearward of a forwardmost part of the ankle strap and at least part of the lateral heel strap rear edge and at least part of the medial heel strap rear edge are forward of a rearmost part of the ankle strap.

17. A foot-receiving device, comprising:

a foot-covering member; and a foot-supporting member including a support member according to claim 1.

18. An article of footwear, comprising:

an upper; and a sole structure engaged with the upper, wherein the sole structure includes a support member according to claim 1.

19. The article of footwear according to claim 18, wherein the support member is included in a midsole element of the sole structure.

20. An article of footwear, comprising:

an upper;

a sole structure engaged with the upper, wherein the sole structure includes a support member for a plantar surface of a foot, wherein the support member includes:

a heel support plate located in a heel area of the sole structure, a forefoot support plate located in a forefoot area of the sole structure, wherein the forefoot support plate includes: (a) a forefoot plantar support surface, (b) a first lateral wrap extending from a ball portion of the support member toward a lateral side of the sole structure, wherein an outside perimeter edge of the first lateral wrap includes a first raised side wall extending upward from the forefoot plantar support surface, wherein the first raised side wall is configured to engage and support a lateral side surface of a wearer's foot and (c) a second lateral wrap extending from the ball portion of the support member toward the lateral side of the sole structure, wherein an outside perimeter edge of the second lateral wrap includes a second raised side wall extending upward from the forefoot plantar support surface, wherein the second raised side wall is configured to engage and support the lateral side surface of a wearer's foot, and a rotatable connection between the heel support plate and the forefoot support plate, wherein the rotatable connection includes a heel lateral wing, a heel medial wing, a forefoot lateral wing and a forefoot medial wing, wherein the heel lateral wing extends from a lateral side of the heel support plate and the heel medial wing extends from a medial side of the heel support plate, and further wherein the forefoot lateral wing extends from a lateral side of the forefoot support plate and the forefoot medial wing extends from a medial side of the forefoot support plate, wherein interaction of the heel medial wing, the heel lateral wing, the forefoot medial wing, and the forefoot lateral wing of the rotatable connection allows the heel support plate to rotate internally with respect to the forefoot support plate and limits an extent of external rotation of the heel support plate with respect to the forefoot support plate; and a heel securing strap component configured to engage the heel support plate with a wearer's heel.

21. The article of footwear according to claim 20, wherein the heel securing strap component includes:

a medial side junction area, a lateral side junction area, a lower medial strap component that extends from the medial side junction area and under a medial side of the heel support plate, a lower lateral strap component that extends from the lateral side junction area and under a lateral side of the heel support plate, a rear heel strap component that extends from the medial side junction area to the lateral side junction area to engage around a rear heel portion of a wearer's foot, an upper medial strap component that extends from the medial side junction area toward a medial instep area of the article of footwear, and an upper lateral strap component that extends from the lateral side junction area toward a lateral instep area of the article of footwear.

22. The article of footwear according to claim 20, wherein the heel securing strap component includes:

a medial side junction area, a lateral side junction area, a lower strap component that extends from the medial side junction area to the lateral side junction area under the heel support plate, a rear heel strap component that extends from the medial side junction area to the lateral side junction area to engage around a rear heel portion of a wearer's foot, an upper medial strap component that extends from the medial side junction area toward a medial instep area of the article of footwear, and an upper lateral strap component that extends from the lateral side junction area toward a lateral instep area of the article of footwear.

* * * * *